US009072938B2

(12) United States Patent
Steiert

(10) Patent No.: US 9,072,938 B2
(45) Date of Patent: Jul. 7, 2015

(54) EXERCISE MACHINE FOR MUSCLE SPEED AND EXPLOSIVENESS

(71) Applicant: Dak Brandon Steiert, Edwards, CO (US)

(72) Inventor: Dak Brandon Steiert, Edwards, CO (US)

( * ) Notice: Subject to any disclaimer, the term of this patent is extended or adjusted under 35 U.S.C. 154(b) by 0 days.

(21) Appl. No.: 14/103,756

(22) Filed: Dec. 11, 2013

(65) Prior Publication Data

US 2014/0100083 A1 Apr. 10, 2014

Related U.S. Application Data

(63) Continuation-in-part of application No. 12/849,139, filed on Aug. 3, 2010, now abandoned.

(51) Int. Cl.

| | |
|---|---|
| ***A63B 22/00*** | (2006.01) |
| ***A63B 71/00*** | (2006.01) |
| ***A63B 21/00*** | (2006.01) |
| ***A63B 21/005*** | (2006.01) |
| ***A63B 69/00*** | (2006.01) |
| ***A63B 21/008*** | (2006.01) |
| ***A63B 23/04*** | (2006.01) |
| ***A63B 24/00*** | (2006.01) |
| *A63B 69/06* | (2006.01) |
| *A63B 21/012* | (2006.01) |
| *A63B 21/02* | (2006.01) |
| *A63B 22/06* | (2006.01) |
| *A63B 23/035* | (2006.01) |
| *A63B 23/12* | (2006.01) |

(52) U.S. Cl.

CPC ..... *A63B 21/15* (2013.01); *A63B 21/005* (2013.01); *A63B 21/00192* (2013.01); *A63B 69/0053* (2013.01); *A63B 69/06* (2013.01); *A63B 21/0081* (2013.01); *A63B 21/0085* (2013.01); *A63B 21/012* (2013.01); *A63B 21/02* (2013.01); *A63B 21/1469* (2013.01); *A63B 2220/10* (2013.01); *A63B 2220/20* (2013.01); *A63B 2220/30* (2013.01); *A63B 2220/40* (2013.01); *A63B 2220/50* (2013.01); *A63B 2220/62* (2013.01); *A63B 2220/801* (2013.01); *A63B 21/00196* (2013.01); *A63B 2230/605* (2013.01); *A63B 2230/425* (2013.01); *A63B 21/1484* (2013.01); *A63B 22/06* (2013.01); *A63B 22/0605* (2013.01); *A63B 22/0664* (2013.01); *A63B 23/03525* (2013.01); *A63B 23/0405* (2013.01); *A63B 23/1209* (2013.01); *A63B 24/0087* (2013.01); *A63B 2021/021* (2013.01); *A63B 2230/062* (2013.01); *A63B 2230/105* (2013.01)

(58) Field of Classification Search

USPC ..... 482/1, 4–7, 111–120, 139

See application file for complete search history.

(56) References Cited

U.S. PATENT DOCUMENTS

| | | | | |
|---|---|---|---|---|
| 4,765,610 | A * | 8/1988 | Sidwell | 482/94 |
| 5,476,428 | A * | 12/1995 | Potash et al. | 482/5 |
| 5,730,686 | A * | 3/1998 | Nilsson | 482/114 |
| 6,679,812 | B2 * | 1/2004 | Torkelson | 482/51 |
| 7,695,416 | B2 * | 4/2010 | Weiner | 482/137 |

(Continued)

*Primary Examiner* — Oren Ginsberg

(57) ABSTRACT

As shown in FIG. 1 the exercise machine of the preferred embodiments includes a mechanical force input interface 1 designed to interface with a user 5 and allow the user 5 to input force 4 into the exercise machine; a force resistor 2 that functions to resist force input into the mechanical force input interface 1 by the user 5; and a trigger mechanism 3 that functions to cause a sudden change in the resistance provided against the force input 4 by the user 5. The exercise machine of the preferred embodiments is designed to exercise muscles in a way that improves muscle speed, explosiveness, or both.

37 Claims, 26 Drawing Sheets

(56) References Cited

U.S. PATENT DOCUMENTS

2006/0229164 A1* 10/2006 Einav ..... 482/9
2010/0216600 A1* 8/2010 Noffsinger et al. ..... 482/5
2012/0058859 A1* 3/2012 Elsom-Cook et al. ..... 482/4

* cited by examiner

EXERCISE MACHINE FOR MUSCLE SPEED AND EXPLOSIVENESS

RELATED APPLICATION

This application is a continuation-in-part of, and claims the benefit under 35 U.S.C. 121 of, co-pending U.S. Original application Ser. No. 12/849,139 filed by Dak Brandon Steiert on 3 Aug. 2010 and entitled "EXERCISE MACHINE FOR MUSCLE SPEED AND EXPLOSIVENESS," hereby incorporated in its entirety by reference.

BRIEF DESCRIPTION OF THE FIGURES

FIG. 1*a* and FIG. 1*b* show variations for the system including the disconnect.

FIG. 1*b* is a schematic representation of the system of the first preferred embodiment wherein a disconnect is coupled to the mechanical force input interface and coupled to the force resistor, and wherein variations for the mechanical force input interface are displayed.

FIG. 3*a* and FIG. 3*b* show variations of the system of the first embodiment including the forcing device.

FIG. 3*b* is a schematic representation of the system of the first preferred embodiment wherein the force resistor is coupled to a forcing device that applies force to the mechanical force input interface to cause a sudden net reduction in resistance force against the user, wherein the trigger is coupled at least to the forcing device, and wherein variations of the mechanical force input interface are displayed.

DESCRIPTION OF THE PREFERRED EMBODIMENTS

The following description of the preferred embodiments of the invention is intended to enable someone skilled in the prior art to make and use this invention, but is not intended to limit the invention to these preferred embodiments.

1. First Preferred Embodiment

Figure 1A:
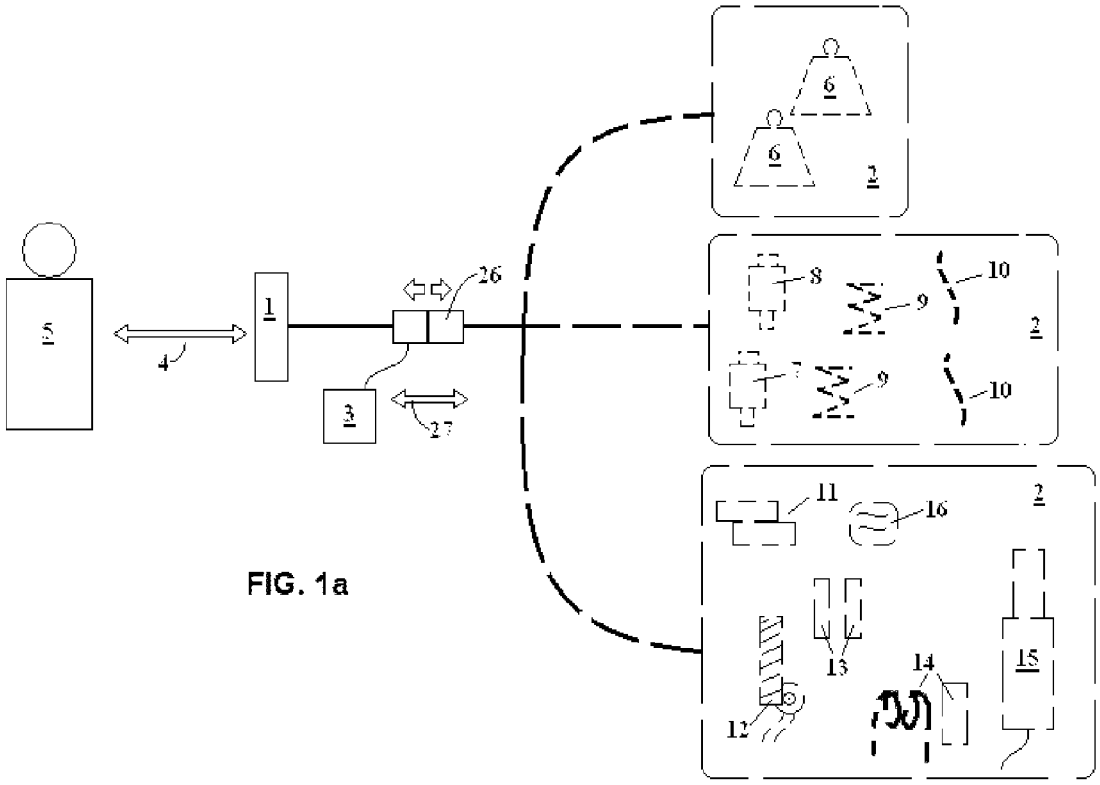
FIG. 1*a* is a schematic representation of the system of the first preferred embodiment wherein a disconnect is coupled to the mechanical force input interface and coupled to the force resistor, and wherein variations for the force resistor are displayed.
Figure 1B:
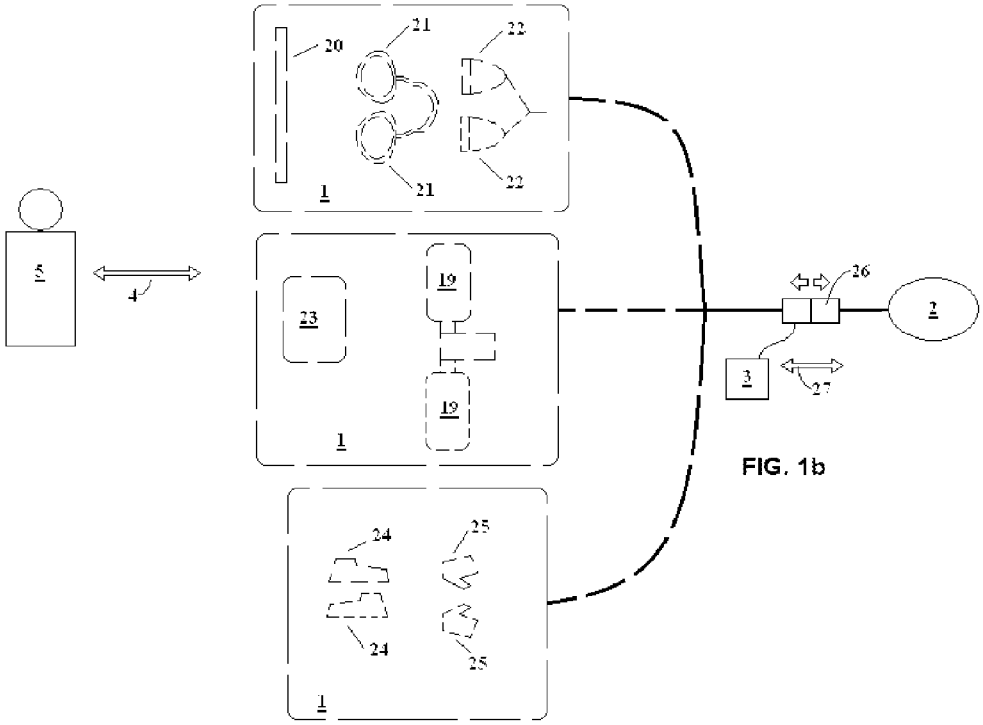

As shown in FIG. 1 the exercise machine of the preferred embodiments includes a mechanical force input interface 1 designed to interface with a user 5 and allow the user 5 to input force 4 into the exercise machine; a force resistor 2 that functions to resist force input into the mechanical force input interface 1 by a user 5; and a trigger mechanism 3 that functions to cause a sudden change in the resistance provided against the force input 4 by the user 5. The exercise machine of the preferred embodiments is designed to exercise muscles in a way that improves muscle speed, explosiveness, or both. Sudden is defined by the Oxford dictionary as "occurring or done quickly and unexpectedly or without warning"—given human reaction times of roughly 500 milliseconds the force reduction is expected to take place in under roughly 500 milliseconds. This is only described as a minimum effective time for sudden operation, not to provide an optimal range of operation. The reduction in force should take place quickly enough that the user will not easily react and reduce their force output, which would be roughly under 500 milliseconds. This exercise machine is does not operate in the same mode or with similarities to a spotting device or machine. If a spotting machine were to operate in the same ranges of this exercise machine, it would likely injure its user. The exercise machine of the preferred embodiments is designed to encourage rapid user motion acceleration in safe circumstances. The operation of this exercise machine could not, under any circumstances, be considered as an operating range of a spotting machine or an adjustable weight machine, particularly due to the reasons of user safety with operating other machine types in the ranges of sudden force reduction used in the exercise machine of the preferred embodiments. The exercise machine of the preferred embodiments may be configured to exercise any muscle of the body in any motion, providing any muscle in any motion with increased muscle speed, explosiveness, or both. The exercise machine of the preferred embodiments, however, may be used for any suitable purpose.

The change in the resistance provided against the force input 4 by the user 5 into the exercise machine of the system of the first preferred embodiment preferably functions to reduce the resistance force the machine provides against the force input 4 by the user 5. In a second preferred variation, the change in resistance provided against the force input 4 by the user 5 functions to provide force assisting the force input 4 by the user 5, preferably making the motion of the user 5 easier, but alternatively acting in any suitable manner. Alternatively, the change in resistance provided against the force input 4 by the user 5 functions to change the direction of the resistance provided against the force input 4 by the user 5. The change in the resistance provided against the force input 4 by the user 5 may, however, function in any suitable manner. Preferably the change in resistance provided against the force input 4 by the user 5 occurs quickly, though it may occur at any suitable rate or over any suitable period of time.

As shown in FIG. 1, in a first preferred variation of the system of the first preferred embodiment, the force resistor 2 is coupled to the mechanical force input interface 1. As shown in FIG. 1, in a second preferred variation the force resistor 2 is coupled to the trigger mechanism 3. As shown in FIG. 1, in an alternative variation the force resistor 2 is coupled to both the mechanical force input interface 1 and to the trigger mechanism 3. The force resistor 2 may, however, be coupled to any suitable combination of the trigger mechanism 3 and the mechanical force input interface 1, or through any other suitable devices, and in any suitable manner that allows the force resistor 2 to transmit resistance to the user 5.

Figure 2A:
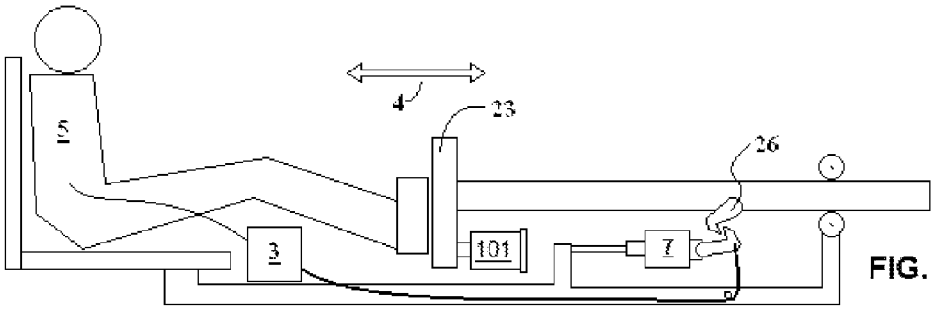
FIG. 2*a* is a schematic representation of an example variation of the system of the first preferred embodiment wherein the user performs a leg press exercise against a platform, wherein the movement of the platform is resisted by a hydraulic device, and wherein the trigger activates a disconnect to cause a sudden reduction in net resistance force against the leg press exercise.
Figure 2B:
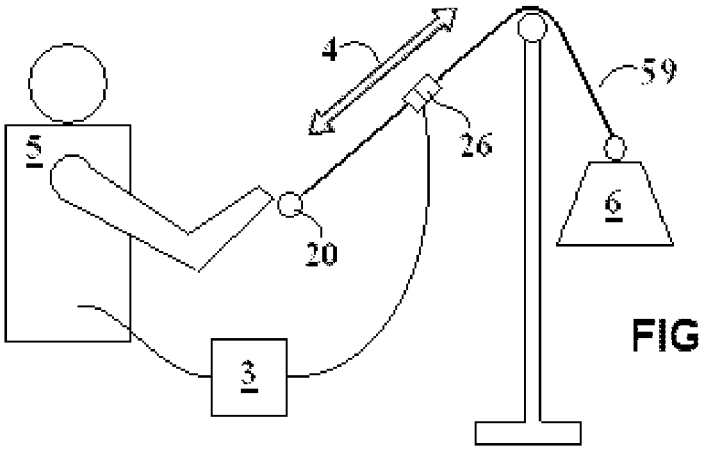
FIG. 2*b* is a schematic representation of an example variation of the system of the first preferred embodiment wherein the user inputs force into a bar connected by a cable to a disconnect, wherein a cable connects the disconnect to at least one weight, and wherein the trigger mechanism activates a disconnect to cause a sudden reduction in net resistance force.
Figure 2C:
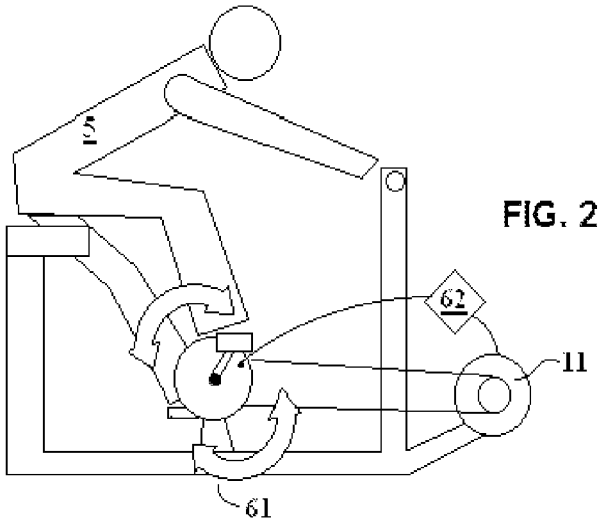
FIG. 2*c* is a schematic representation of an example variation of the system of the first preferred embodiment wherein the user rides a bicycle, wherein a friction device is coupled to the bicycle pedal assembly, wherein a cyclical trigger is coupled to the friction device and causes a cyclical sudden reduction in net resistance against the force input by the user, wherein the bicycle pedals can be actuated in either forward or rearward direction.
Figure 3A:
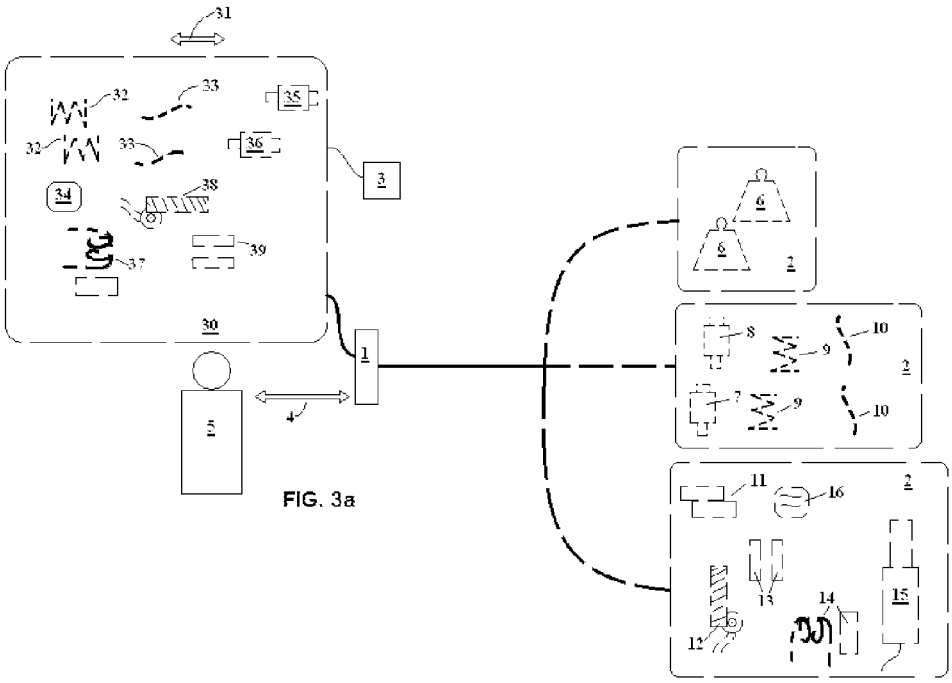
FIG. 3*a* is a schematic representation of the system of the first preferred embodiment wherein the force resistor is coupled to a forcing device that applies force to the mechanical force input interface to cause a sudden net reduction in resistance force against the user, wherein the trigger is coupled at least to the forcing device, and wherein variations of the force resistor are displayed.
Figure 3B:
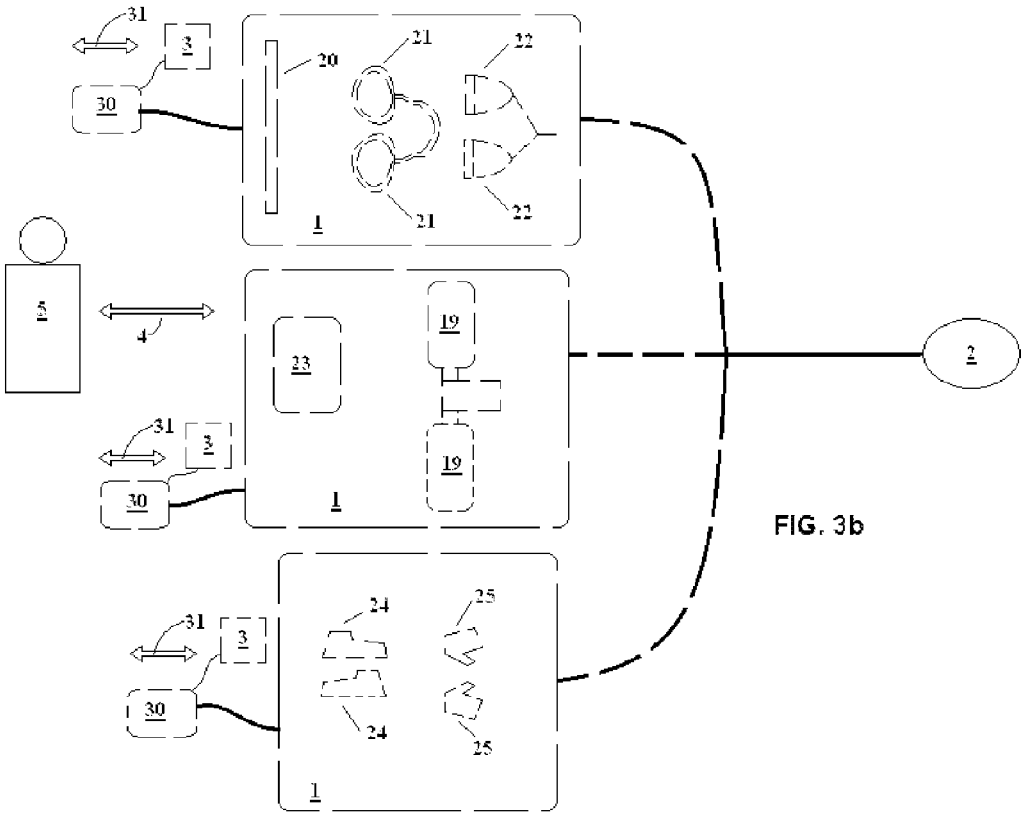
Figure 4:
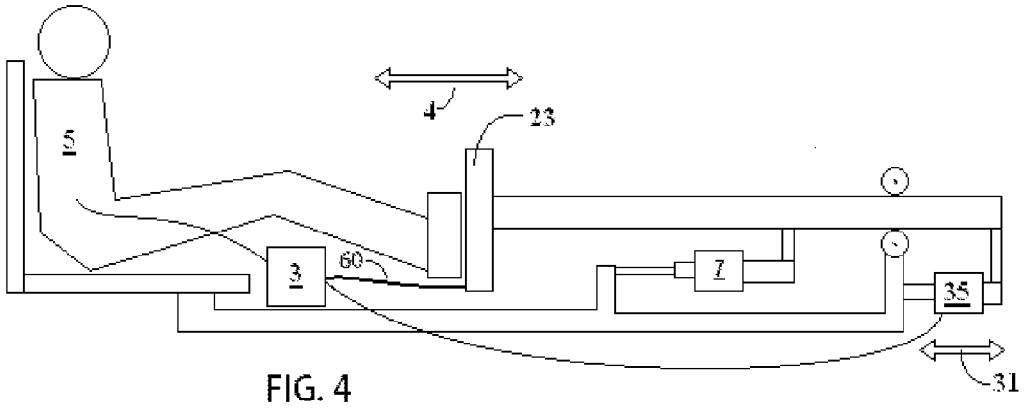
FIG. 4 is a schematic representation of an example variation of the system of the first preferred embodiment wherein the user performs a leg press exercise against a platform, wherein the movement of the platform is resisted by a hydraulic device, wherein the trigger activates a pneumatic to cause a sudden reduction in net resistance force against the leg press exercise, and wherein at least one cable is also coupled to the trigger and to the platform to provide a control of the trigger in addition to user control.
Figure 5:
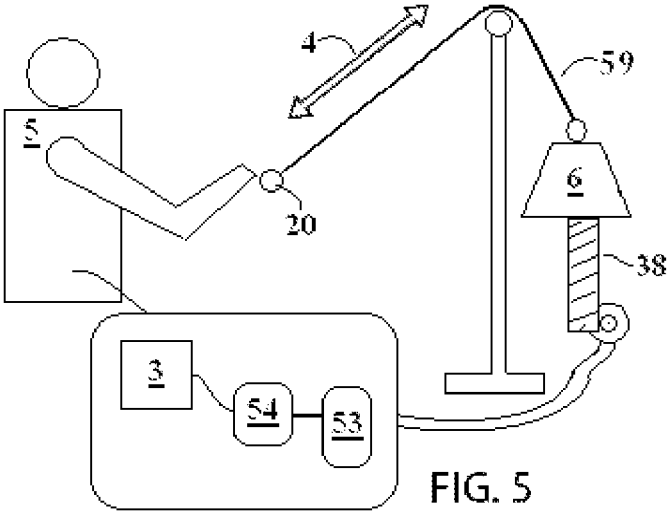
FIG. 5 is a schematic representation of an example variation of the system of the first preferred embodiment wherein the user inputs force into a bar connected by a cable to at least one weight, and wherein the trigger mechanism is either coupled to a processor and an electronic system, or consists of a processor and electronic system, and wherein at least one of the electronic system and the trigger mechanism activates an electromechanical device to cause a sudden reduction in net resistance force.

As shown in FIG. 2, in a first preferred variation of the force resistor 2 of the first preferred embodiment, the force resistor 2 includes one or more weights 6. As shown in FIG. 3*a*, in a second preferred variation the force resistor 2 includes a hydraulic device 7. As shown in FIG. 3*b*, in a third preferred variation the force resistor 2 includes a pneumatic device 8. As shown in FIG. 3*c*, in a fourth preferred variation the force resistor 2 includes one or more springs 9. As shown in FIG. 3*d*, in a fifth preferred variation the force resistor 2 includes one or more elastic elements 10. As shown in FIG. 4, in an alternative variation the force resistor 2 includes a friction mechanism 11. As shown in FIG. 5*a*, in another alternative variation the force resistor 2 includes an electromechanical device 12, preferably designed to exert force in resistance to the force input 4 by the user 5. As shown in FIG. 5*b*, in another alternative variation the force resistor 2 includes a magnetic device 13. In a first preferred variation of the magnetic device 13, the magnetic device 13 includes a permanent magnet and a magnetic induction device designed to produce resistance force. In a second preferred variation of the magnetic device 13, the magnetic device 13 includes two or more permanent magnets designed to produce a resistance force between them; however the magnetic device 13 may have any suitable design. As shown in FIG. 5*c*, in another alternative variation the force resistor 2 includes an electromagnetic device 14. In a first preferred variation of the electromagnetic device 14, the electromagnetic device 14 includes an electromagnet and a magnetic induction device designed to produce resistance force. In a second preferred variation of the electromagnetic device 14, the electromagnetic device 14 includes one or more electromagnets and one or more permanent magnets designed to produce a resistance force between them. In a third preferred variation of the electromagnetic device 14, the electromagnetic device 14 includes two or more electromagnets designed to produce a resistance force between them, however the electromagnetic device 14 may have any suitable design. As shown in FIG. 5*d*, in another alternative variation the force resistor 2 includes an actuator 15. As shown in FIG. 5*e*, in another alternative variation the force resistor 2 includes a flowing fluid designed to induce drag 16 and create a resistance force opposing the force input 4 by the user 5. In a first preferred variation of the flowing fluid designed to induce drag 16, the flowing fluid designed to induce drag 16 includes a flowing fluid passing through a device including an object in the fluid stream that is designed to undergo a drag force in the fluid stream. In a second preferred variation of the flowing fluid designed to induce drag 16, the flowing fluid designed to induce drag 16 includes a flowing fluid passing over a part of the user 5 and designed to create a drag force on that part of the user 5. In a third preferred variation of the flowing fluid designed to induce drag 16, the flowing fluid designed to induce drag 16 includes a drag inducing object attached to the user 5 or worn by the user 5 and designed to create a drag force when in the path of the flowing fluid 16. The force resistor 2 may, however, include any suitable combination of these variations and may, alternatively, include any suitable device or combination of devices.

As shown in FIG. 1, in a preferred variation of the system of the first preferred embodiment, the mechanical force input interface 1 is coupled to the force resistor 2. As shown in FIG. 1, in a second preferred variation the mechanical force input interface 1 is coupled to the trigger mechanism 3. As shown in FIG. 1, in a third preferred variation the mechanical force input interface 1 is coupled to both the trigger mechanism 3 and the force resistor 2. The mechanical force input interface 1 may, however, be coupled to any suitable combination of the force resistor 2 and the trigger mechanism 3, or through any other suitable devices, and in any suitable manner that allows the mechanical force input interface 1 to receive force input 4 by the user 5 and allows the mechanical force input interface 1 to receive and transmit resistance force from the force resistor 2.

Figure 6A:
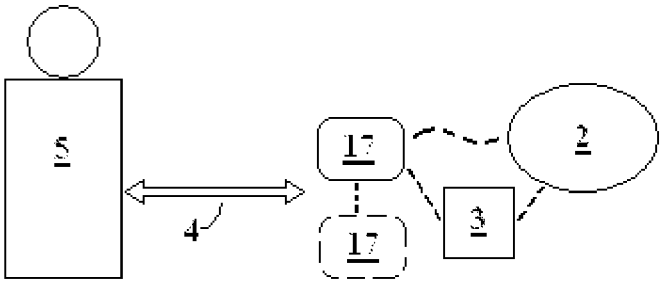
FIG. 6*a* is a schematic representation of the system of the first preferred embodiment wherein the mechanical force input interface comprises at least one pedal.
Figure 6B:
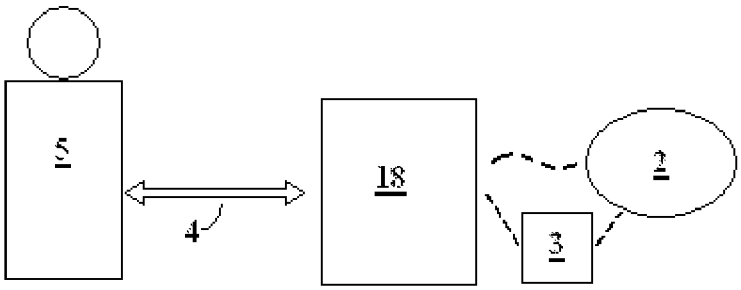
FIG. 6*b* is a schematic representation of the system of the first preferred embodiment wherein the mechanical force input interface comprises a platform.
Figure 6C:
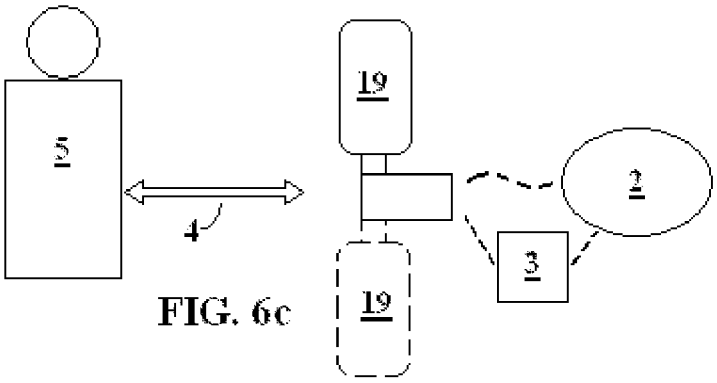
FIG. 6*c* is a schematic representation of the system of the first preferred embodiment wherein the mechanical force input interface comprises at least one padded structural member.
Figure 7A:
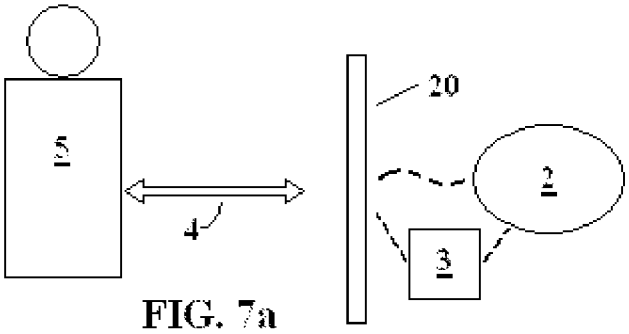
FIG. 7*a* is a schematic representation of the system of the first preferred embodiment wherein the mechanical force input interface comprises a bar.
Figure 7B:
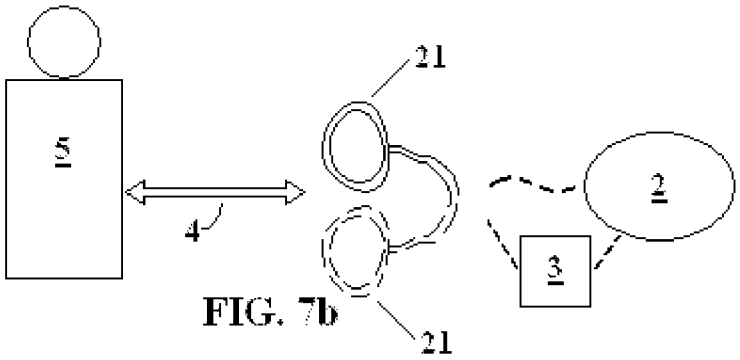
FIG. 7*b* is a schematic representation of the system of the first preferred embodiment wherein the mechanical force input interface comprises at least one strap.
Figure 7C:
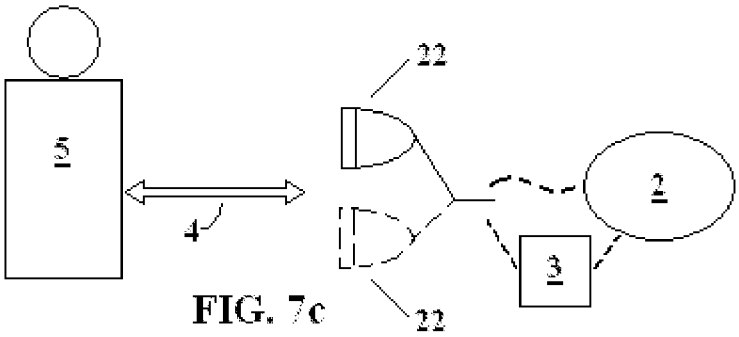
FIG. 7*c* is a schematic representation of the system of the first preferred embodiment wherein the mechanical force input interface comprises at least one handle.
Figure 8A:
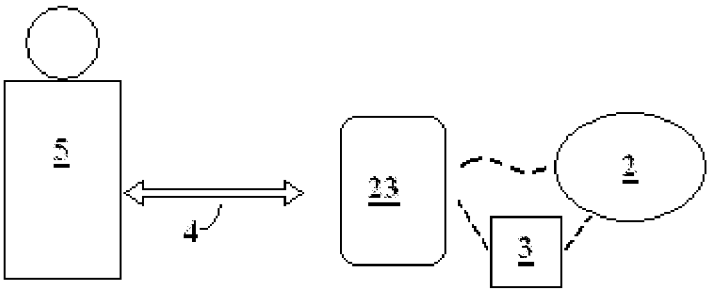
FIG. 8*a* is a schematic representation of the system of the first preferred embodiment wherein the mechanical force input interface comprises an article of clothing.
Figure 8B:
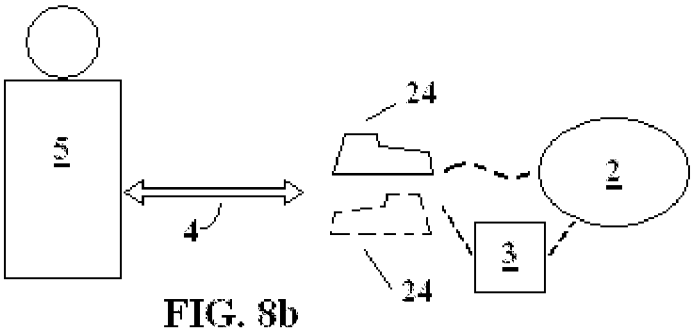
FIG. 8*b* is a schematic representation of the system of the first preferred embodiment wherein the mechanical force input interface comprises at least one shoe.
Figure 8C:
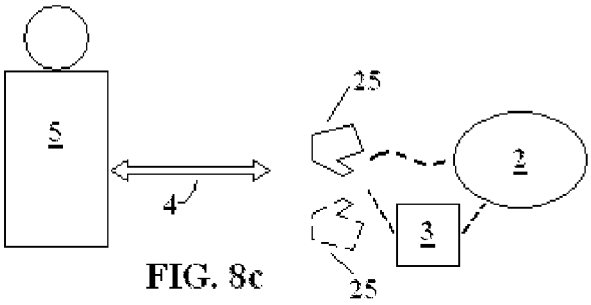
FIG. 8*c* is a schematic representation of the system of the first preferred embodiment wherein the mechanical force input interface comprises at least one glove.

As shown in FIG. 6*a*, in a first preferred variation of the mechanical force input interface 1 of the system of the first preferred embodiment, the mechanical force input interface 1 includes one or more pedals 17. As shown in FIG. 6*b*, in a second preferred variation the mechanical force input interface 1 includes a platform 18. As shown in FIG. 6*c*, in a third preferred variation the mechanical force input interface 1 includes one or more padded structural members 19. The one or more padded structural members 19 preferably include a bar or tube covered in a pad or pad material and attached to a structure that preferably pivots or slides. The one or more padded structural members 19 may, however, include any suitable components and configuration, and may move in any suitable manner. As shown in FIG. 7*a*, in a fourth preferred variation the mechanical force input interface 1 includes a bar 20. The bar 20 is preferably designed to have the user 5 hold onto the bar 20 with one or both of the user's hands, though the bar 20 may have any suitable design. As shown in FIG. 7*b*, in a fifth preferred variation the mechanical force input interface 1 includes one or more straps 21. In a first preferred variation of the one or more straps 21, the one or more straps 21 are designed to have the user 5 hold the one or more straps with one or both of the user's hands. In a second preferred variation of the one or more straps 21, the one or more straps 21 are designed to have the user 5 place the one or more straps around one of: one or more of their feet, one or more of their ankles, one or more of their legs, or any combination of these. In a third preferred variation of the one or more straps 21, the one or more straps 21 are designed to have the user 5 place the one or more straps around one of: one or more of their wrists, one or more of their arms, or any combination of these. The one or more straps 21 may, however, have any suitable design. As shown in FIG. 7*c*, in a sixth preferred variation the mechanical force input interface 1 includes one or more handles 22. The one or more handles 22 are preferably designed to have the user 5 hold onto the one or more handles 22 with one or both of the user's hands, though the one or more handles 22 may have any suitable design. As shown in FIG. 8*a*, in an alternative variation the mechanical force input interface 1 includes an article of clothing 23. The article of clothing 23 preferably includes one of: a shirt, pants, a vest, shorts, or any other item worn on the body, and preferably includes a strap, cable, ring, or any other suitable attachment point capable of transmitting force. In an alternative variation of the article of clothing 23, the article of clothing 23 includes magnets or magnetic inductance elements. The article of clothing 23 may, however, have any suitable design that allows it to act as a mechanical force input interface 1. As shown in FIG. 8*b*, in another alternative variation the mechanical force input interface 1 includes one or more shoes 24. The one or more shoes 24 preferably include a strap, cable, ring or any other suitable attachment point capable of transmitting force. In an alternative variation of the one or more shoes 24, the one or more shoes 24 include magnets or magnetic inductance elements. In another alternative variation of the one or more shoes 24, the one or more shoes 24 include drag inducing objects designed to interact with the flowing fluid designed to induce drag 16. The one or more shoes 24 may, however, have any suitable design that allows them to act as a mechanical force input interface 1. As shown in FIG. 8*c*, in another alternative variation the mechanical force input interface 1 includes one or more gloves 25. The one or more gloves 25 preferably include a strap, cable, ring or any other suitable attachment point capable of transmitting force. In an alternative variation of the one or more gloves 25, the one or more gloves 25 include magnets or magnetic inductance elements. In another alternative variation of the one or more gloves 25, the one or more gloves 25 include drag inducing objects designed to interact with the flowing fluid designed to induce drag 16. The one or more gloves 25 may, however, have any suitable design that allows them to act as a mechanical force input interface 1.

Figure 9A:
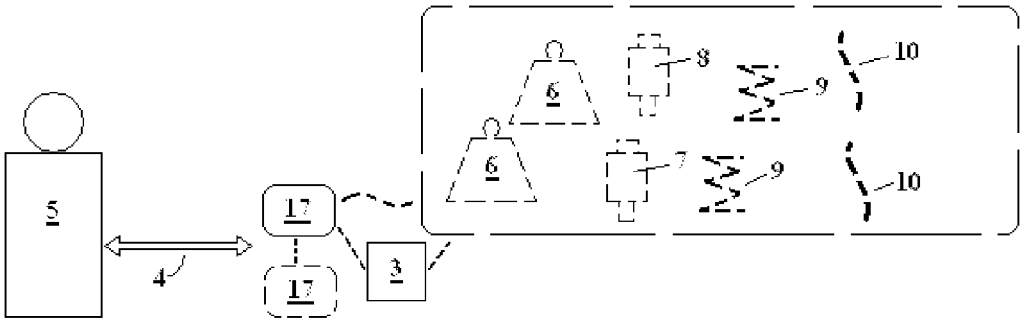
FIG. 9*a* is a schematic representation of the system of the first preferred embodiment wherein the mechanical force input interface comprises at least one pedal, and wherein the force resistor comprises at least one of (a) a hydraulic device, (b) a pneumatic device, (c) at least one weight, (d) at least one spring, and (e) at least one elastic element.
Figure 9B:
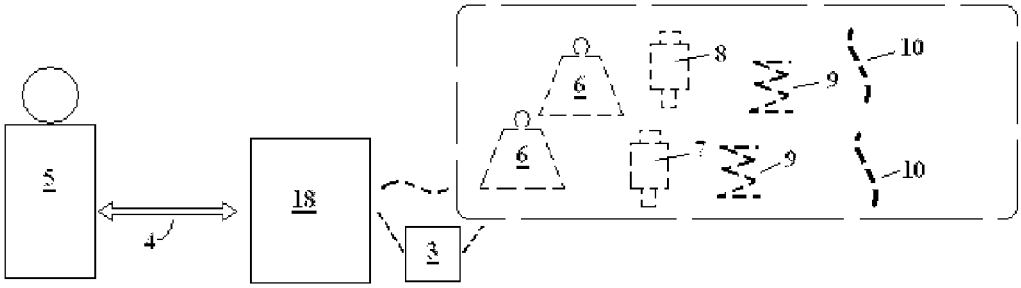
FIG. 9*b* is a schematic representation of the system of the first preferred embodiment wherein the mechanical force input interface comprises a platform, and wherein the force resistor comprises at least one of (a) a hydraulic device, (b) a pneumatic device, (c) at least one weight, (d) at least one spring, and (e) at least one elastic element.
Figure 9C:
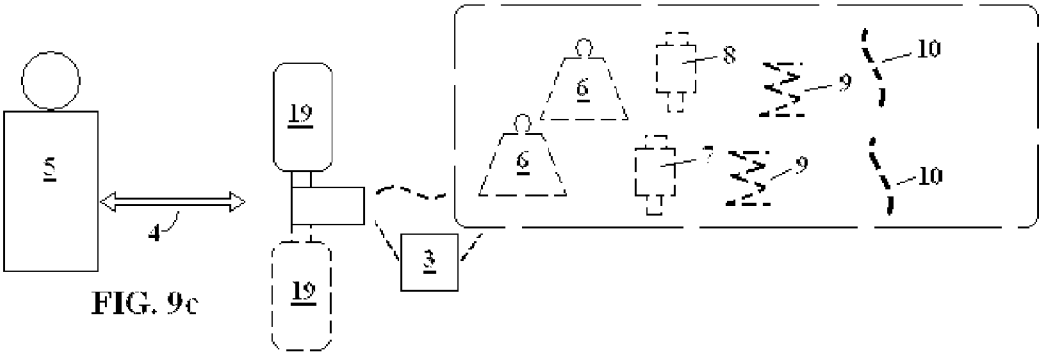
FIG. 9*c* is a schematic representation of the system of the first preferred embodiment wherein the mechanical force input interface comprises at least one padded structural member, and wherein the force resistor comprises at least one of (a) a hydraulic device, (b) a pneumatic device, (c) at least one weight, (d) at least one spring, and (e) at least one elastic element.
Figure 10A:
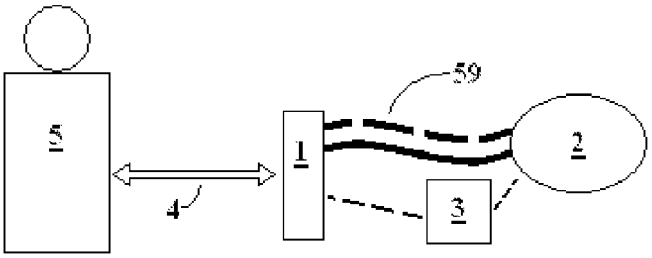
FIG. 10*a* is a schematic representation of the system of the first preferred embodiment wherein the coupling between the mechanical force input interface and the force resistor comprises at least one cable.
Figure 10B:
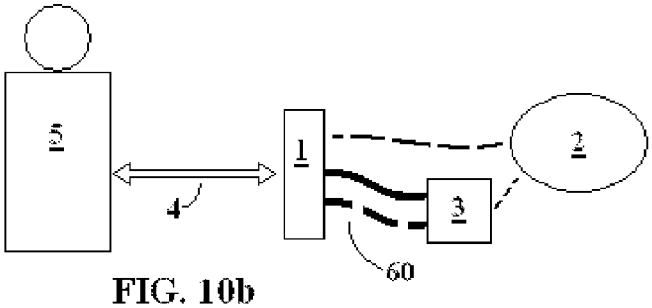
FIG. 10*b* is a schematic representation of the system of the first preferred embodiment wherein the coupling between the mechanical force input interface and the trigger mechanism comprises at least one cable.
Figure 11A:
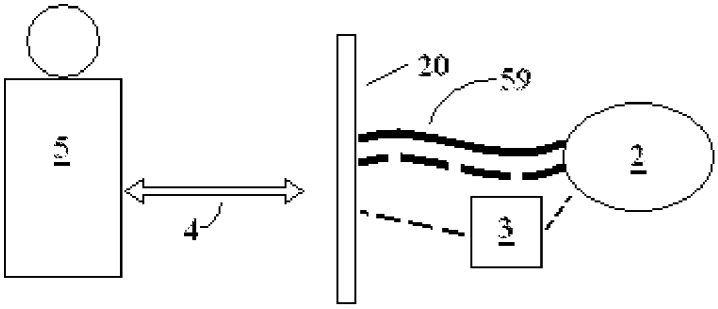
FIG. 11*a* is a schematic representation of the system of the first preferred embodiment wherein the coupling between the mechanical force input interface and the force resistor comprises at least one cable, and wherein the mechanical force input interface comprises a bar.
Figure 11B:
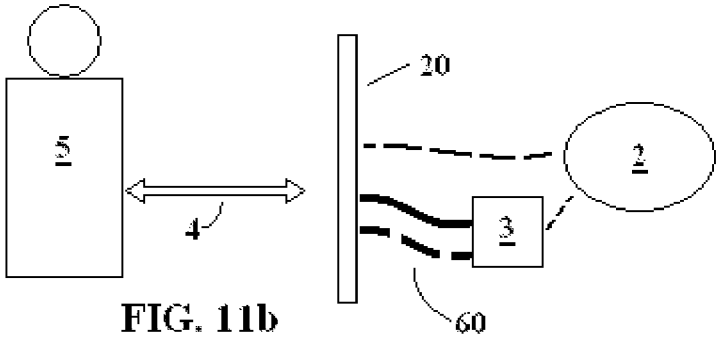
FIG. 11*b* is a schematic representation of the system of the first preferred embodiment wherein the coupling between the mechanical force input interface and the trigger mechanism comprises at least one cable, and wherein the mechanical force input interface comprises a bar.
Figure 11C:
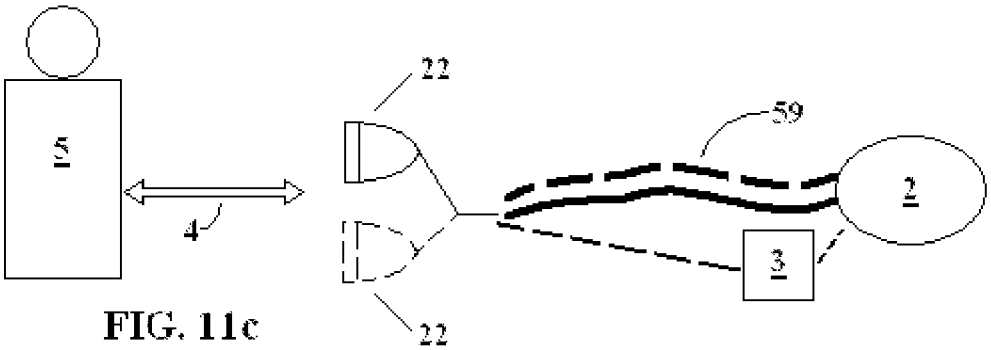
FIG. 11*c* is a schematic representation of the system of the first preferred embodiment wherein the coupling between the mechanical force input interface and the force resistor comprises at least one cable, and wherein the mechanical force input interface comprises at least one handle.
Figure 11D:
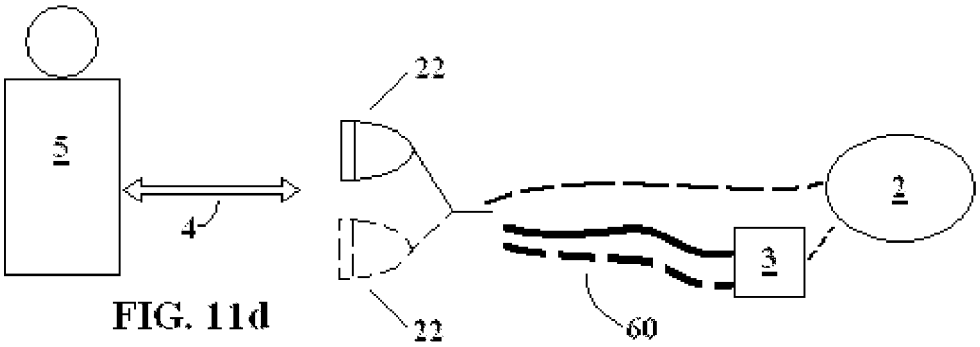
FIG. 11*d* is a schematic representation of the system of the first preferred embodiment wherein the coupling between the mechanical force input interface and the trigger mechanism comprises at least one cable, and wherein the mechanical force input interface comprises at least one handle.
Figure 11E:
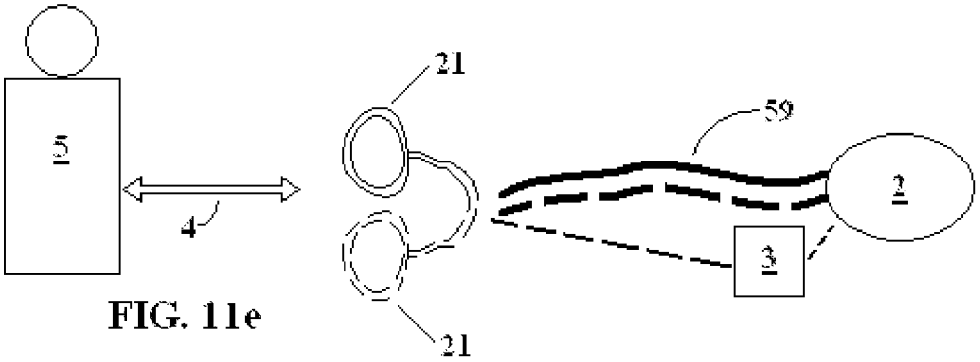
FIG. 11*e* is a schematic representation of the system of the first preferred embodiment wherein the coupling between the mechanical force input interface and the force resistor comprises at least one cable, and wherein the mechanical force input interface comprises at least one strap.
Figure 11F:
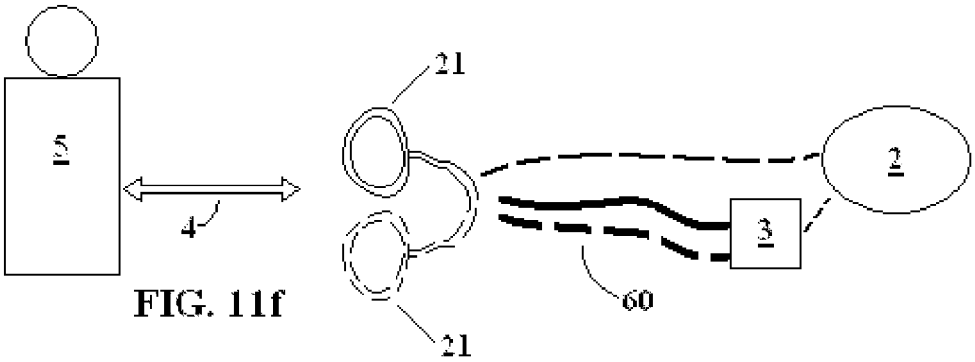
FIG. 11*f* is a schematic representation of the system of the first preferred embodiment wherein the coupling between the mechanical force input interface and the trigger mechanism comprises at least one cable, and wherein the mechanical force input interface comprises at least one strap.

As shown in FIG. 9*a*, in a first preferred variation of the configuration of the system of the first preferred embodiment, the mechanical force input interface 1 includes one or more pedals 17 and the force resistor 2 includes one or more of: a hydraulic device 7, a pneumatic device 8, one or more weights 6, one or more springs 9, one or more elastic elements 10, or any combination of these. In the first preferred variation shown in FIG. 9*a*, the one or more pedals 17 are preferably attached to the trigger mechanism 3 and the trigger mechanism 3 is preferably attached to the force resistor 2. In the first preferred variation shown in FIG. 9*a*, the action of the trigger mechanism 3 preferably quickly releases one of: the attachment of the trigger mechanism 3 to the force resistor 2, the attachment of the trigger mechanism 3 to the one or more pedals 17, or both, preferably allowing the one or more pedals 17 to move with reduced or eliminated resistance. In the first preferred variation shown in FIG. 9*a*, the one or more pedals 17 preferably slide along a track. In the first preferred variation as shown in FIG. 9*a*, the one or more pedals 17 are alternatively attached to a pivoting structure. In the first preferred variation as shown in FIG. 9*a*, the one or more pedals 17 are alternatively attached to a structure designed to allow them to move in an elliptical or circular motion. The one or more pedals 17 included in the first preferred variation shown in FIG. 9*a* may, however, be designed to move in any suitable manner, may be attached in any suitable manner, and may interact with the trigger mechanism 3 and the force resistor 2 in any suitable manner. In the first preferred variation as shown in FIG. 9*a*, the system preferably includes a seat for the user 5, however the system may include any suitable accommodations for the user 5, or may not include any additional structures or accommodations. In a second preferred variation of the configuration of the system of the first preferred embodiment, as shown in FIG. 9*b*, the mechanical force input interface 1 includes a platform 18 and the force resistor 2 includes one or more of: a hydraulic device 7, a pneumatic device 8, one or more weights 6, one or more springs 9, one or more elastic elements 10, or any combination of these. In the second preferred variation shown in FIG. 9*b*, the platform 18 is preferably attached to the trigger mechanism 3 and the trigger mechanism 3 is preferably attached to the force resistor 2. In the second preferred variation shown in FIG. 9*b*, the action of the trigger mechanism 3 preferably quickly releases one of: the attachment of the trigger mechanism 3 to the force resistor 2, the attachment of the trigger mechanism 3 to the platform 18, or both, preferably allowing the platform 18 to move with reduced or eliminated resistance. In the second preferred variation shown in FIG. 9*b*, the platform 18 preferably slides along a track. In the second preferred variation shown in FIG. 9*b*, the platform 18 is alternatively attached to a pivoting structure. The platform 18 included in the second preferred variation shown in FIG. 9*b* may, however, be designed to move in any suitable manner, may be attached in any suitable manner, and may interact with the trigger mechanism 3 and the force resistor 2 in any suitable manner. In the second preferred variation shown in FIG. 9*b*, the system preferably includes a seat for the user 5, however the system may include any suitable accommodations for the user 5, or may not include any additional structures or accommodations. In a third preferred variation of the configuration of the system of the first preferred embodiment, as shown in FIG. 9*c*, the mechanical force input interface 1 includes one or more padded structural members 19 and the force resistor 2 includes one or more of: a hydraulic device 7, a pneumatic device 8, one or more weights 6, one or more springs 9, one or more elastic elements 10, or any combination of these. In the third preferred variation shown in FIG. 9*c*, the one or more padded structural members 19 are preferably attached to the trigger mechanism 3 and the trigger mechanism 3 is preferably attached to the force resistor 2. In the third preferred variation shown in FIG. 9*c*, the action of the trigger mechanism 3 preferably quickly releases one of: the attachment of the trigger mechanism 3 to the force resistor 2, the attachment of the trigger mechanism 3 to the one or more padded structural members 19, or both, preferably allowing the one or more padded structural members 19 to move with reduced or eliminated resistance. In the third preferred variation shown in FIG. 9*c*, the one or more padded structural members 19 preferably slide along a track. In the third preferred variation shown in FIG. 9*c*, the one or more padded structural members 19 are alternatively attached to a pivoting structure. The one or more padded structural members 19 included in the third preferred variation shown in FIG. 9*c* may, however, be designed to move in any suitable manner, may be attached in any suitable manner, and may interact with the trigger mechanism 3 and the force resistor 2 in any suitable manner. In the third preferred variation as shown in FIG. 9*c*, the system preferably includes a seat for the user 5, however the system may include any suitable accommodations for the user 5, or may not include any additional structures or accommodations. In a fourth preferred variation of the configuration of the system of the first preferred embodiment, as shown in FIGS. 10*a* and 10*b*, the system is configured with one of: the coupling between the mechanical force input interface 1 and the force resistor 2 including one or more cables 59, the coupling between the mechanical force input interface 1 and the trigger mechanism 3 including one or more cables 60, or both. As shown in FIGS. 11*a* and 11*b*, in a first preferred variation of the configuration shown in FIGS. 10*a* and 10*b*, the mechanical force input interface 1 includes a bar 20. Preferably, as shown in FIG. 11*b*, one or more cables 60 connect the bar 20 to the trigger mechanism 3 and the trigger mechanism 3 is designed to quickly release one of: the connection of the trigger mechanism 3 to the one or more cables, the connection of the trigger mechanism 3 to the force resistor 2, or both. Alternatively, one or more cables 59 connect the bar 20 to the force resistor 2, as shown in FIG. 11*a*. However, the cables may be connected to any suitable device in any suitable way and the trigger mechanism 3 may act in any suitable manner. As shown in FIGS. 11*c* and 11*d*, in a second preferred variation of the configuration shown in FIGS. 10*a* and 10*b*, the mechanical force input interface 1 includes one or more handles 22. Preferably, as shown in FIG. 11*d*, one or more cables 60 connect the one or more handles 22 to the trigger mechanism 3 and the trigger mechanism 3 is designed to quickly release one of: the connection of the trigger mechanism 3 to the one or more cables, the connection of the trigger mechanism 3 to the force resistor 2, or both. Alternatively, one or more cables 59 connect the one or more handles 22 to the force resistor 2, as shown in FIG. 11*c*. However, the cables may be connected to any suitable device in any suitable way and the trigger mechanism 3 may act in any suitable manner. As shown in FIGS. 11*e* and 11*f*, in a third preferred variation of the configuration shown in FIGS. 10*a* and 10*b*, the mechanical force input interface 1 includes one or more straps 21. Preferably, as shown in FIG. 11*f*, one or more cables 60 connect the one or more straps 21 to the trigger mechanism 3 and the trigger mechanism 3 is designed to quickly release one of: the connection of the trigger mechanism 3 to the one or more cables, the connection of the trigger mechanism 3 to the force resistor 2, or both. Alternatively, one or more cables 59 connect the one or more straps 21 to the force resistor 2, as shown in FIG. 11*e*. However, the cables may be connected to any suitable device in any suitable way and the trigger mechanism 3 may act in any suitable manner. In the fourth preferred variation of the configuration of the system of the first preferred embodiment shown in FIGS. 10*a* and 10*b*, the coupling between the mechanical force input interface 1 and one of the force resistor 2 and the trigger mechanism 3 preferably includes one or more pulleys which preferably provide a suitable angle for the one or more cables to attach to the mechanical force input interface 1. The one or more pulleys may provide an adjustable angle for the one or more cables to attach to the mechanical force input interface 1; however, the coupling may include any suitable devices and be designed in any suitable manner.

Figure 12:
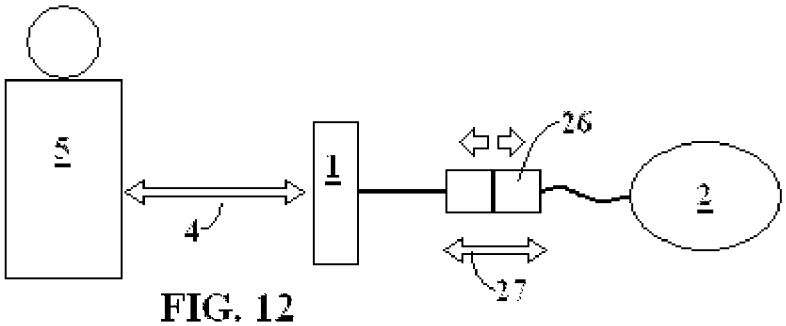
FIG. 12 is a schematic representation of the system of the first preferred embodiment wherein the trigger mechanism comprises a disconnect, wherein the disconnect is adapted to transmit force between the force resistor and the mechanical force input interface, wherein the disconnect is further adapted to uncouple the force resistor and the mechanical force input interface.
Figure 13A:
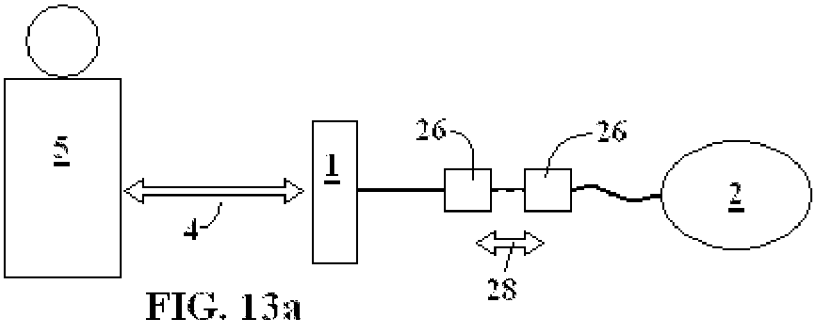
FIG. 13*a* is a schematic representation of the system of the first preferred embodiment wherein the uncoupling of the disconnect has reduced the resistance force transmitted between the force resistor and the mechanical force input interface.
Figure 13B:
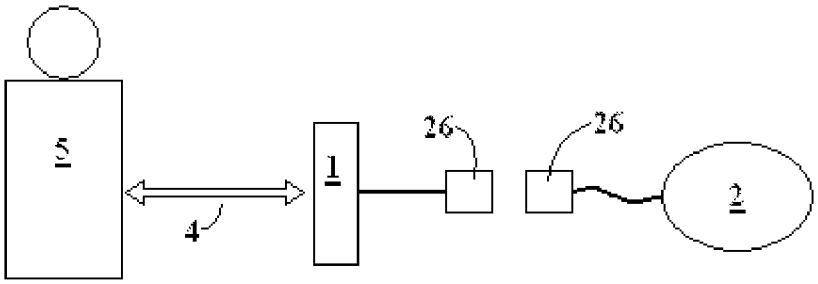
FIG. 13*b* is a schematic representation of the system of the first preferred embodiment wherein the uncoupling of the disconnect has eliminated the resistance force transmission between the force resistor and the mechanical force input interface.
Figure 13C:
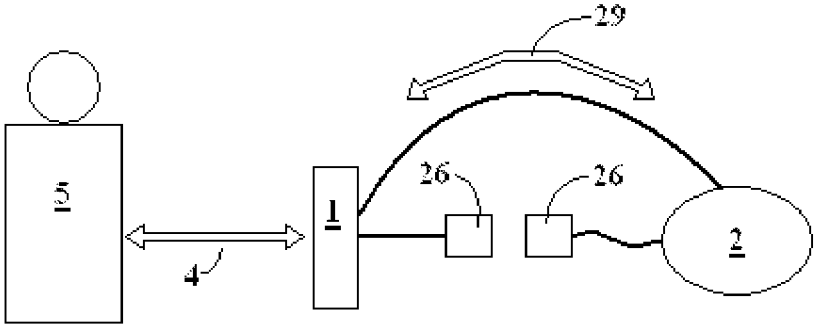
FIG. 13*c* is a schematic representation of the system of the first preferred embodiment wherein the uncoupling of the disconnect has changed the direction of the resistance force transmitted between the force resistor and the mechanical force input interface.

As shown in FIG. 12, in a first preferred variation of the trigger mechanism 3 of the system of the first preferred embodiment, the trigger mechanism 3 includes a disconnect 26 coupled to the mechanical force input interface 1 and coupled to the force resistor 2. The disconnect 26 is designed to transmit force 27 between the force resistor 2 and the mechanical force input interface 1 and the disconnect 26 is designed to uncouple the force resistor 2 and the mechanical force input interface 1. The disconnect 26 preferably includes one or more of: a latch, a catch, or a pin retention system, however the disconnect 26 may have any suitable design allowing it to uncouple the force resistor 2 and the mechanical force input interface 1. The disconnect 26 preferably acts quickly, however it may operate in any suitable manner. As shown in FIG. 13*a*, the uncoupling of the force resistor 2 and the mechanical force input interface 1 caused by the disconnect 26 preferably causes a reduced the resistance force 28 to be transmitted between the force resistor 2 and the mechanical force input interface 1. In a second preferred variation of the action of the disconnect 26, as shown in FIG. 13*b*, the uncoupling of the force resistor 2 and the mechanical force input interface 1 caused by the disconnect 26 causes the elimination of resistance force transmission 46 between the force resistor 2 and the mechanical force input interface 1. Elimination of the resistance force transmission would be a 100% reduction in resistance force transmitted between the force resistor and the mechanical force input interface, however with reasonable mechanical losses, the inertia and mass of any components of the system not disconnected, and friction, the actual net reduction in resistance force applied against the user through the mechanical force input interface would be expected by someone experienced in prior art to be less than 100%, but roughly 60% or more. The net reduction in resistance force must also be significant enough to create significant acceleration of the user's motion, which would be roughly greater than 60%. This is one preferred variation, not an optimal range of operation. A significant reduction is required for appropriate operation of the device, greater than 60% being a rough point at which the reduction is significant enough to provide proper operation, not the optimal point or range. The device must provide a significant increase in the speed of the user movement upon the sudden reduction in force, without this acceleration it does not operate properly and increase muscle explosiveness. This requires a net reduction of at least 60% in force in under 500 milliseconds for proper operation, but this is not an ideal range. The preferred operation creates an acceleration of the user's motion to nearly as fast as they could carry out the same motion under no load. In other preferred variations the acceleration of the user's motion may result in a motion faster than the user could carry out the same motion under no load, due to assistance force and other factors involved in the operation of the exercise machine and the sudden reduction in resistance force. This means that in the preferred variations the acceleration of the user's motion after the sudden reduction in force will result in a motion that is at least several times faster after the reduction in force than before the reduction in force. The acceleration in the preferred embodiments generally will result in a user motion after the sudden reduction of force that is at least 20 times (2000%) faster than the motion of the user prior to the sudden reduction of force. This at least 2000% acceleration is not an ideal operation range for the device, it is simply a rough minimum of the range at which the device begins to have an effect on muscle explosiveness. In another preferred variation assistance might be provided to the user after the reduction of force resisting the user, which could aide in accelerating the sudden motion of the user. In one variation this involves elimination, or nearly 100% reduction in resistance force, plus the addition of assistance force. In another variation, an assistance force is continuously applied against the resistance force applied to the force input interface, in some preferred variations by a spring or actuator, and the sudden reduction in resistance force results in a net assisting force. In a third preferred variation of the action of the disconnect 26, as shown in FIG. 13*c*, the uncoupling of the force resistor 2 and the mechanical force input interface 1 caused by the disconnect 26 causes a change in the direction 29 of the resistance force transmitted between the force resistor 2 and the mechanical force input interface 1. The disconnect 26 may, however, operate in any suitable manner and cause any suitable change in the resistance force transmitted between the force resistor 2 and the mechanical force input interface 1. In another preferred variation, a brake mechanism 101 is included that safely slows the user's motion at the end of the user's range of motion. This is preferably included to ensure the safety of the user's joint, because suddenly releasing resistance force without a brake would cause an acceleration of the user's motion that will be ended by the user's joint, or by the end of the machine's range of motion. Allowing repeated halting of a fast motion cause by either the user's joint or the end of the machine's range of motion will cause stress injury if a brake mechanism 101 is not incorporated to slow the user's motion more gradually. The brake mechanism 101 must begin slowing the user's motion before the user reaches the end of their body's physical ability to continue that motion and before the user reaches the end of the range of motion of the exercise machine. The brake mechanism 101 is preferably constructed with one of: elastic bands, padding material, pneumatic or hydraulic pistons, or friction braking mechanisms. However, the braking mechanism 101 may be created with any suitable device. The brake mechanism 101 in one variation is adjustable so the point at which it engages is adjustable. In another variation the brake mechanism 101 is adjustable in the level of braking force it provides. It may, however, be adjustable in both characteristics, or not adjustable at all.

Figure 14A:
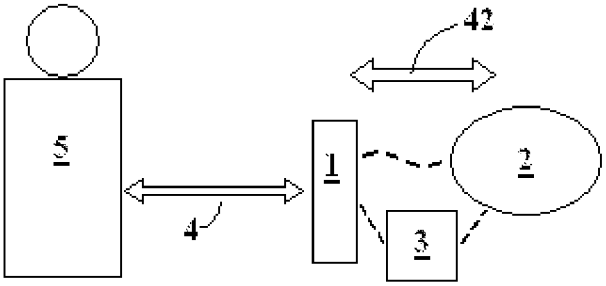
FIG. 14*a* is a schematic representation of the system of the first preferred embodiment before the action of the trigger mechanism, wherein there is resistance force transmitted between the force resistor and the mechanical force input interface.
Figure 14B:
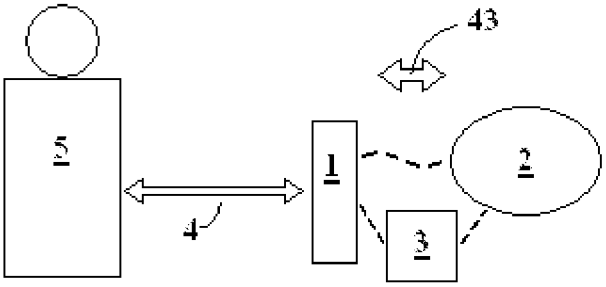
FIG. 14*b* is a schematic representation of the system of the first preferred embodiment after the action of the trigger mechanism, wherein the resistance force transmitted between the force resistor and the mechanical force input interface has been reduced.
Figure 14C:
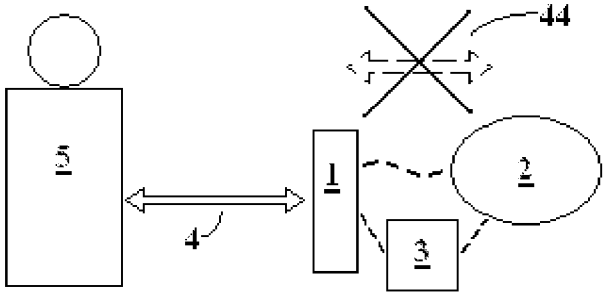
FIG. 14*c* is a schematic representation of the system of the first preferred embodiment after the action of the trigger mechanism, wherein the resistance force transmitted between the force resistor and the mechanical force input interface has been eliminated.
Figure 14D:
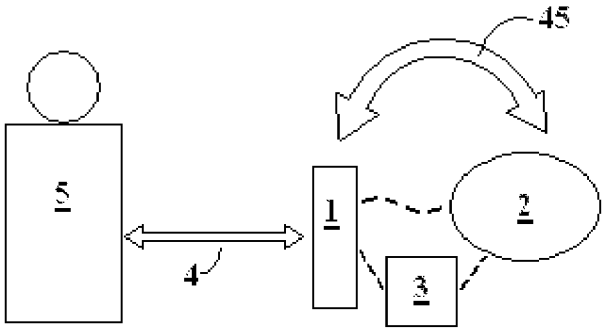
FIG. 14*d* is a schematic representation of the system of the first preferred embodiment after the action of the trigger mechanism, wherein the resistance force transmitted between the force resistor and the mechanical force input interface has been changed in direction.

In a second preferred variation of the trigger mechanism 3 of the system of the first preferred embodiment, as shown in FIGS. 14*a* and 14*b*, the trigger mechanism 3 is designed to cause a reduction in the resistance force transmitted between the force resistor 2 and the mechanical force input interface 1. As shown in FIG. 14*a* the resistance force transmitted 42 between the force resistor 2 and the mechanical force input interface 1 before the action of the trigger mechanism 3 becomes, as shown in FIG. 14*b*, the reduced resistance force 43 transmitted between the force resistor 2 and the mechanical force input interface 1 after the action of the trigger mechanism 3. In a third preferred variation of the trigger mechanism 3, as shown in FIG. 14*c*, the trigger mechanism 3 is designed to cause the elimination of force transmission 46 between the force resistor 2 and the mechanical force input interface 1. The resistance force 42 transmitted between the force resistor 2 and the mechanical force input interface 1 before the action of the trigger mechanism 3, as shown in FIG. 14*a*, becomes the eliminated resistance force 44 after the action of the trigger mechanism, as shown in FIG. 14*c*. In a fourth preferred variation of the trigger mechanism 3, as shown in FIG. 14*d*, the trigger mechanism 3 is designed to cause a change in direction 45 of the force transmitted between the force resistor 2 and the mechanical force input interface 1. The resistance force transmitted 42 between the force resistor 2 and the mechanical force input interface 1 before the action of the trigger mechanism 3, as shown in FIG. 14*a*, becomes the redirected resistance force 45 after the action of the trigger mechanism 3, as shown in FIG. 14*d*. The trigger mechanism 3 may, however, have any suitable design and operate in any suitable manner to create a change in the resistance provided against the force input 4 by the user 5.

Figure 15A:
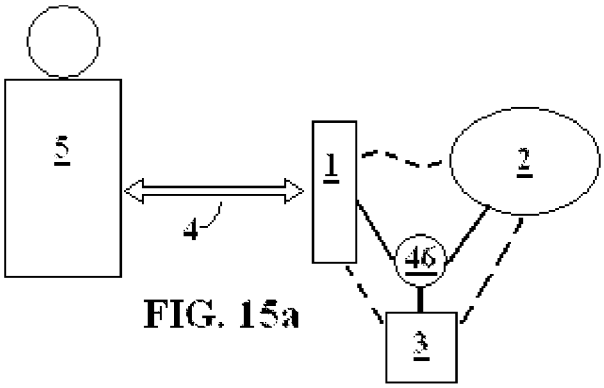
FIG. 15*a* is a schematic representation of the system of the first preferred embodiment further comprising a transmission.
Figure 15B:
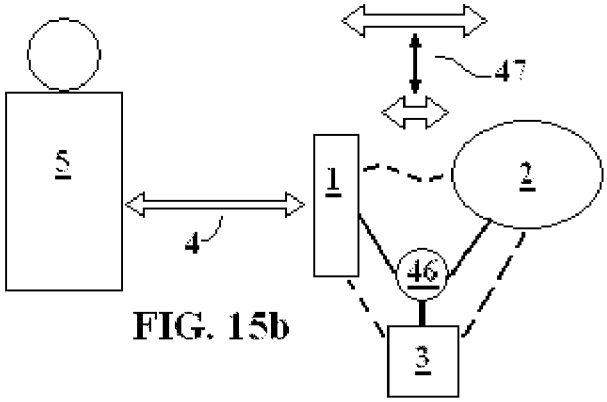
FIG. 15*b* is a schematic representation of the system of the first preferred embodiment further comprising a transmission wherein the transmission is adapted to control the amount of force transmitted between the force resistor and the mechanical force input interface.
Figure 15C:
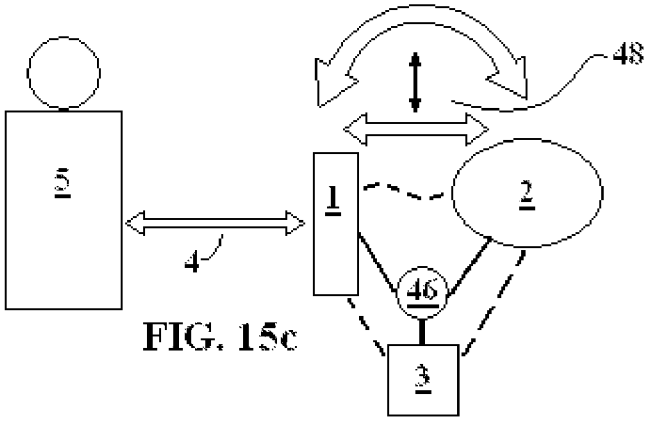
FIG. 15*c* is a schematic representation of the system of the first preferred embodiment further comprising a transmission wherein the transmission is adapted to control the direction of the force transmitted between the force resistor and the mechanical force input interface.

In an alternative variation of the system of the first preferred embodiment, as shown in FIG. 15*a*, the system includes a transmission 46 coupled to the force resistor 2 and coupled to the mechanical force input interface 1. As shown in FIG. 15*a*, the trigger mechanism 3 is coupled at least to the transmission 46 and the trigger mechanism 3, and the trigger mechanism 3 is configured to control the transmission 46. In a first preferred variation of the transmission 46, as shown in FIG. 15*b*, the transmission 46 is designed to control the amount of force 47 transmitted between the force resistor 2 and the mechanical force input interface 1. In a second preferred variation of the transmission 46, as shown in FIG. 15*c*, the transmission 46 is designed to control the direction of force 48 transmitted between the force resistor 2 and the mechanical force input interface 1. However, the transmission 46 may act in any suitable manner to change the resistance provided against the force input 4 by the user 5.

Figure 16:
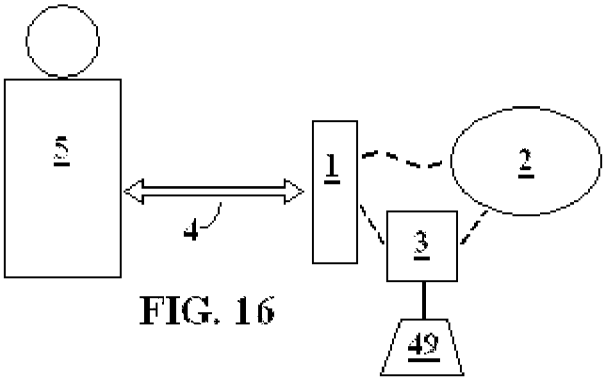
FIG. 16 is a schematic representation of the system of the first preferred embodiment wherein the trigger mechanism is coupled to a trigger.
Figure 17A:
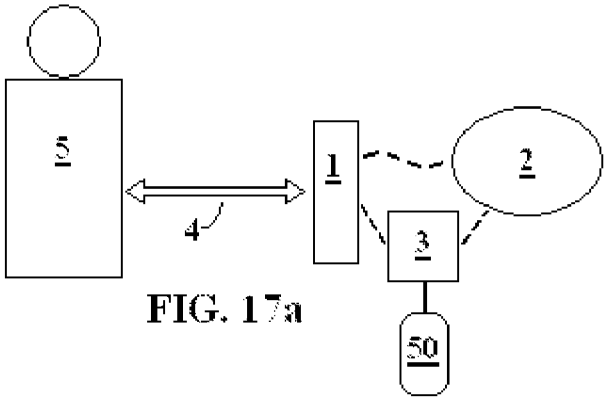
FIG. 17*a* is a schematic representation of the system of the first preferred embodiment wherein the trigger comprises a mechanical system.
Figure 17B:
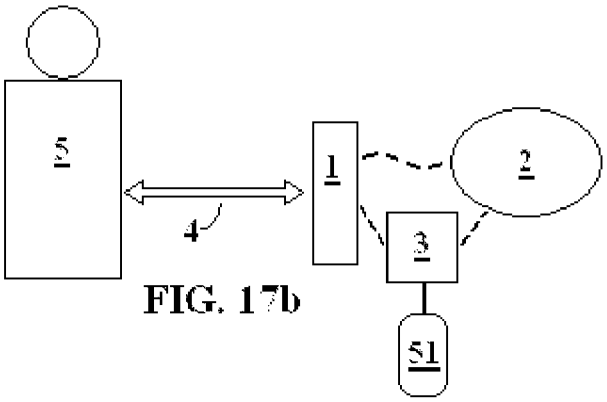
FIG. 17*b* is a schematic representation of the system of the first preferred embodiment wherein the trigger comprises an electronic system.
Figure 17C:
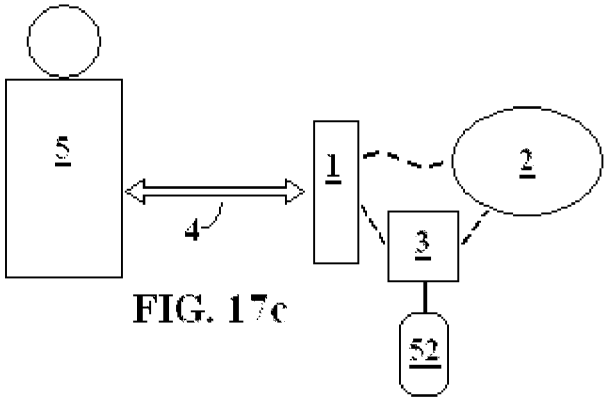
FIG. 17*c* is a schematic representation of the system of the first preferred embodiment wherein the trigger comprises an electromechanical system.
Figure 17D:
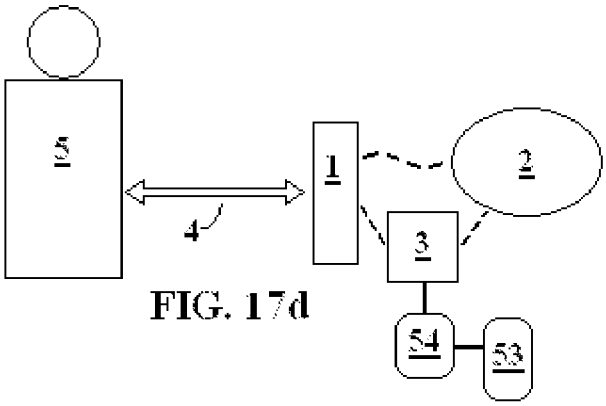
FIG. 17*d* is a schematic representation of the system of the first preferred embodiment wherein the trigger comprises processor coupled to an electronic system.

As shown in FIG. 16, the system of the first preferred embodiment preferably includes a trigger 49 designed to control the trigger mechanism 3. In a first preferred variation of the trigger 49, as shown in FIG. 17*a*, the trigger 49 includes a mechanical system 50. In a second preferred variation, as shown in FIG. 17*b*, the trigger 49 includes an electronic system 51. In a third preferred variation, as shown in FIG. 17*c*, the trigger 49 includes an electromechanical system 52. In a fourth preferred variation, as shown in FIG. 17*d*, the trigger 49 includes a processor 53 coupled to an electronic system 54. The processor 53 preferably controls the electronic system 54 and the processor 53 preferably takes input from at least one sensor or timer, however the processor 53 and electronic system 54 may interact in any suitable way and the processor 53 may operate using any suitable information.

Figure 17E:
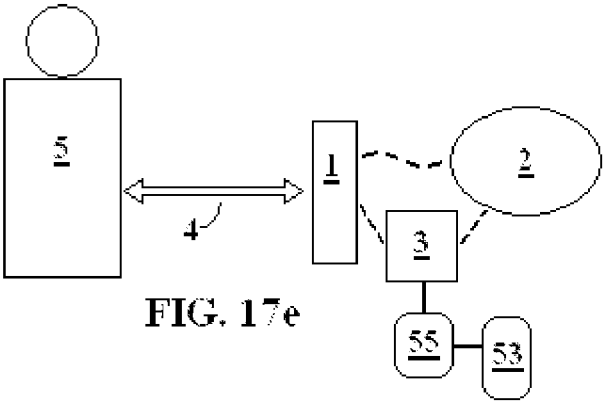
FIG. 17*e* is a schematic representation of the system of the first preferred embodiment wherein the trigger comprises processor coupled to an electromechanical system.

In a fifth preferred variation, as shown in FIG. 17*e*, the trigger 49 includes a processor 53 coupled to an electromechanical system 55. The processor 53 preferably controls the electromechanical system 55 and the processor 53 preferably takes input from at least one sensor or timer, however the processor 53 and electromechanical system 55 may interact in any suitable way and the processor 53 may operate using any suitable information.

Figure 18:
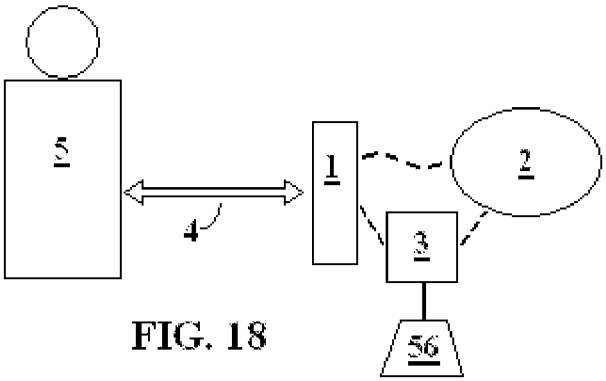
FIG. 18 is a schematic representation of the system of the first preferred embodiment wherein the trigger controls the trigger mechanism automatically.
Figure 19:
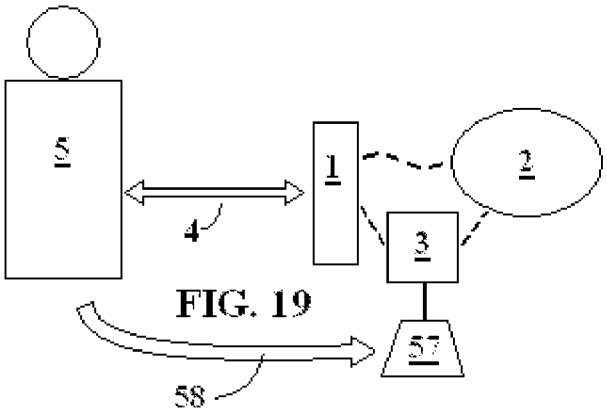
FIG. 19 is a schematic representation of the system of the first preferred embodiment wherein the user controls the trigger.
Figure 20:
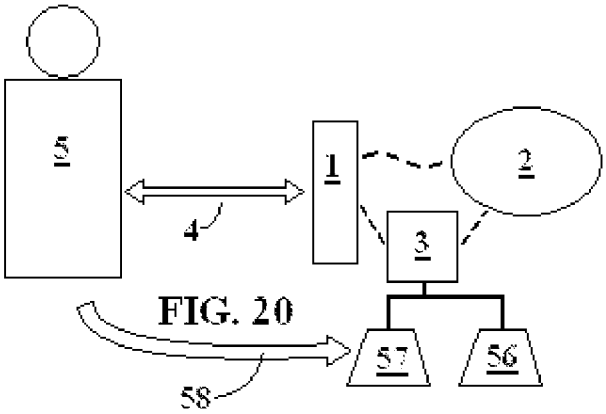
FIG. 20 is a schematic representation of the system of the first preferred embodiment wherein the user controls at least one trigger system and at least one trigger system comprises automatic control.

As shown in FIG. 18, in a first preferred variation of the operation of the trigger 49, the trigger 56 is designed to control the trigger mechanism 3 automatically, preferably without input from the user 5 or other sources external to the system. In a first preferred variation of the trigger 56 controlling the trigger mechanism 3 automatically, the trigger 56 includes a mechanical system that acts based on one of: the force input 4 by the user 5 into the mechanical force input interface 1, the resistance force transmitted to the mechanical force input interface 1 by the force resistor 2, the position of the mechanical force input interface 1, the speed of the mechanical force input interface 1, or any combination of these. In a second preferred variation of the trigger 56 controlling the trigger mechanism 3 automatically, the trigger 56 includes an electronic or an electromechanical system that acts based on one of: the force input 4 by the user 5 into the mechanical force input interface 1, the resistance force transmitted to the mechanical force input interface 1 by the force resistor 2, the rate of change of the force input 4 by the user 5, the rate of change of the resistance force, the position of the mechanical force input interface 1, the speed of the mechanical force input interface 1, the acceleration of the mechanical force input interface 1, or any combination of these. In a third preferred variation of the trigger 56 controlling the trigger mechanism 3 automatically, the trigger 56 includes a processor that acts based on one of: the force input 4 by the user 5 into the mechanical force input interface 1, the resistance force transmitted to the mechanical force input interface 1 by the force resistor 2, the rate of change of the force input 4 by the user 5, the rate of change of the resistance force, the position of the mechanical force input interface 1, the speed of the mechanical force input interface 1, the acceleration of the mechanical force input interface 1, the user's neural activity, the strain of one or more of the user's muscles, the user's heart rate, the user's breathing rate, or any combination of these. The trigger 56 may, however, include any design and use any information or criteria suitable for automatically controlling the trigger mechanism 3. In a second preferred variation of the operation of the trigger 49, as shown in FIG. 19, the user 5 controls the trigger 57 and the trigger 57 only controls the trigger mechanism 3 when given input 58 from the user 5. In a first preferred variation of the user 5 controlling the trigger 57, the trigger 57 is a mechanical system including a handle or other mechanical trigger that the user 5 manipulates with one of: one or more hand, one or more finger, one or more wrist, one or more arm, or any combination of the above. In a second preferred variation of the user 5 controlling the trigger 57, the trigger 57 is a mechanical system including a pedal, catch or other mechanical trigger that the user 5 manipulates with one of: one or more foot, one or more toe, one or more ankle, one or more leg, any other body part, or any combination of the above. In a third preferred variation of the user 5 controlling the trigger 57, the trigger 57 is an electronic or electromechanical system including a button, sensor, or other electronic or electromechanical input device that the user 5 manipulates with one of: one or more finger, one or more hand, one or more toe, one or more foot, one or more arm, one or more leg, any other body part, or any combination of the above. In an alternative variation of the user 5 controlling the trigger 57, the trigger 57 includes a processor that takes input 58 from one of: the user's voice, the user's movements, the user's nervous activity, any other user activity, or any combination of the above. The user 5 may, however, control the trigger 57 in any suitable manner that allows the user 5 to control how the trigger 57 acts, when the trigger 57 acts, or both. In a third preferred variation of the operation of the trigger 49, as shown in FIG. 20, the trigger 49 includes more than one trigger system; at least one of these trigger systems 57 is controlled by the user 5, and at least one of the other trigger systems 56 is designed to operate automatically. Preferably the trigger mechanism 3 is controlled by a combination of the one or more user controlled trigger systems 57 and the one or more automatically controlled trigger 56 systems. In a first preferred variation of the combined automatic and user control, the trigger 49 controls the trigger mechanism 3 when the first of the more than one trigger systems 56,57 acts. In a second preferred variation of the combined automatic and user control, the trigger 49 controls the trigger mechanism 3 when two or more of the more than one trigger systems act 56,57. In a third preferred variation of the combined automatic and user control, the trigger 49 controls the trigger mechanism 3 when all of the more than one trigger systems 56,57 act. In a fourth preferred variation of the combined automatic and user control, the trigger 49 controls the trigger mechanism 3 by mathematically or logically combining the actions or outputs of the more than one trigger systems 56,57 and applying a mathematical or logical criteria that determines when to control the trigger mechanism 3. The combined user and automatic control trigger 49 may, however, operate in any suitable manner and using any suitable criteria.

The trigger 49 is preferably designed to control the trigger mechanism 3 at a point after the user 5 has begun a motion and before the motion is completed or the user 5 has reached the end of the user's range of motion. Preferably the action of the trigger 49 creates two or more phases of motion, one or more phase where the user 5 experiences greater resistance and one or more phase where the user 5 experiences either lesser resistance or assistance. Preferably the transition between these two or more phases of motion occurs quickly. The trigger 49 may, however, act at any suitable point, may create any suitable result, and may act at any suitable rate.

Figure 21:
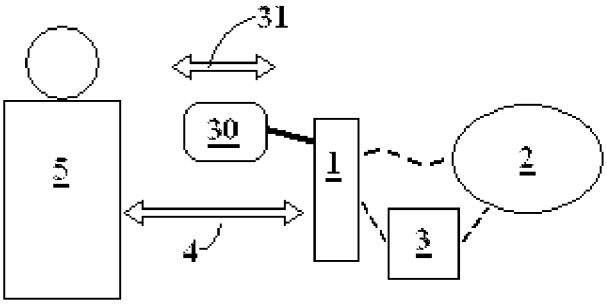
FIG. 21 is a schematic representation of the system of the first preferred embodiment further comprising a forcing device, wherein the forcing device applies force to the mechanical force input interface assisting the force input into the mechanical force input interface by the user.

As shown in FIG. 21, in a preferred variation of the system of the first preferred embodiment, the system includes a forcing device 30 coupled to the mechanical force input interface 1. The forcing device 30 is designed to apply force 31 to the mechanical force input interface 1 in assistance to the force input into the mechanical force input interface 1 by the user 5. In a first preferred variation of the operation of the forcing device 30, the forcing device 30 applies assistance force 31 at least once during the operation of the exercise machine. Preferably the at least one application of assistance force 31 during the operation of the exercise machine occurs once for every motion of the user 5, once for every two or more motions of the user 5, at an uneven or pre-programmed rate during the motions of the user 5, or once for every random number of user motions. However, the at least one application of assistance force 31 during the operation of the exercise machine may occur at any time and any number of times in any relation to user motions. In a second preferred variation of the operation of the forcing device 30, the forcing device 30 continuously applies force 31 to the mechanical force input interface 1 in assistance to the force input into the mechanical input interface by the user 5.

Figure 22A:
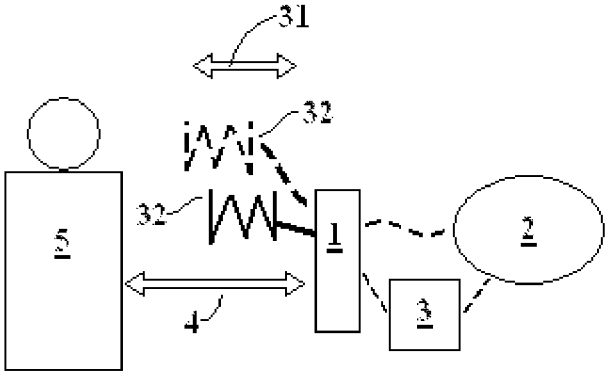
FIG. 22*a* is a schematic representation of the system of the first preferred embodiment wherein the forcing device comprises at least one spring.
Figure 22B:
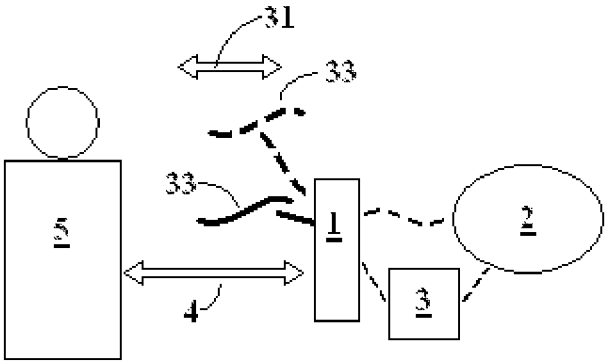
FIG. 22*b* is a schematic representation of the system of the first preferred embodiment wherein the forcing device comprises at least one elastic element.
Figure 22C:
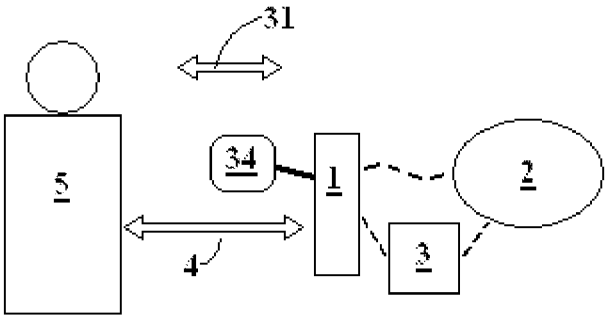
FIG. 22*c* is a schematic representation of the system of the first preferred embodiment wherein the forcing device comprises an actuator.
Figure 22D:
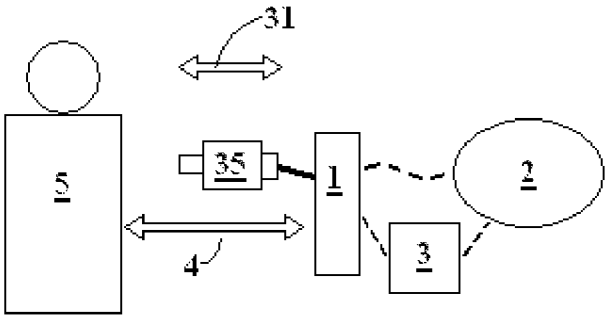
FIG. 22*d* is a schematic representation of the system of the first preferred embodiment wherein the forcing device comprises a pneumatic device.
Figure 22E:
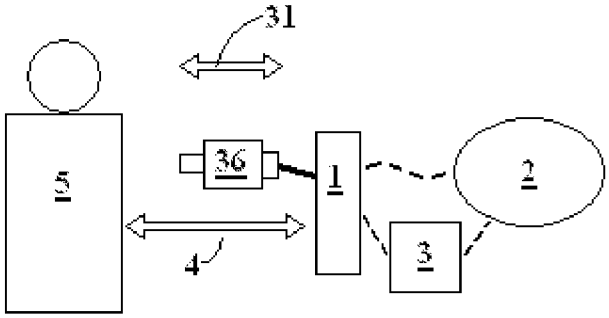
FIG. 22*e* is a schematic representation of the system of the first preferred embodiment wherein the forcing device comprises a hydraulic device.
Figure 22F:
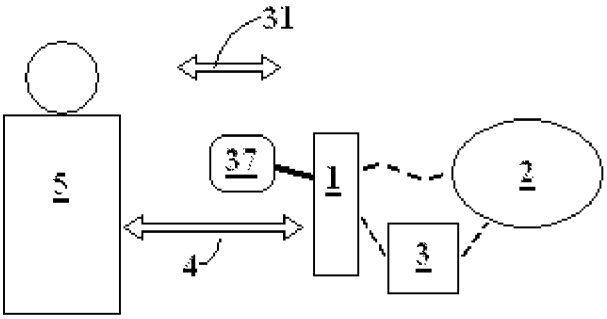
FIG. 22*f* is a schematic representation of the system of the first preferred embodiment wherein the forcing device comprises an electromagnetic device.
Figure 22G:
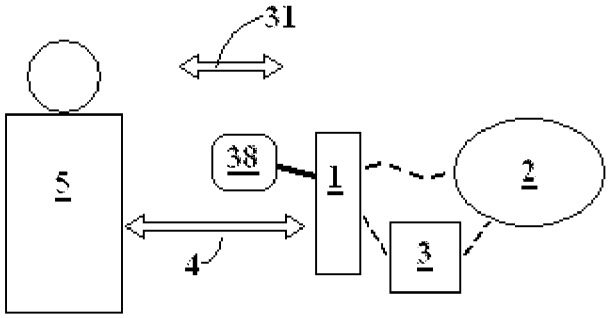
FIG. 22*g* is a schematic representation of the system of the first preferred embodiment wherein the forcing device comprises an electromechanical device.
Figure 22H:
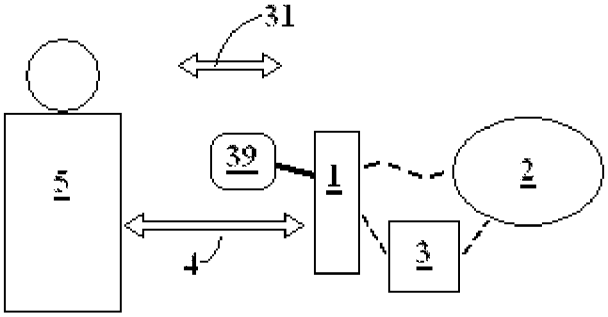
FIG. 22*h* is a schematic representation of the system of the first preferred embodiment wherein the forcing device comprises a magnetic device.

As shown in FIG. 22*a*, in a first preferred variation of the forcing device 30, the forcing device 30 includes one or more springs 32. In a second preferred variation of the forcing device 30, as shown in FIG. 22*b*, the forcing device 30 includes one or more elastic elements 33. In a third preferred variation of the forcing device 30, as shown in FIG. 22*c*, the forcing device 30 includes an actuator 34. In a fourth preferred variation of the forcing device 30, as shown in FIG. 22*d*, the forcing device 30 includes a pneumatic device 35. In a fifth preferred variation of the forcing device 30, as shown in FIG. 22*e*, the forcing device 30 includes a hydraulic device 36. In a fifth preferred variation of the forcing device 30, as shown in FIG. 22*f*, the forcing device 30 includes an electromagnetic device 37. In a sixth preferred variation of the forcing device 30, as shown in FIG. 22*g*, the forcing device 30 includes an electromechanical device 38. In an alternative variation of the forcing device 30, as shown in FIG. 22*h*, the forcing device 30 includes a magnetic device 39. The forcing device 30 may, however, include any combination of these devices or may have any suitable design allowing it to provide force in assistance to the force the input into the mechanical force input interface 1 by the user 5.

Figure 23A:
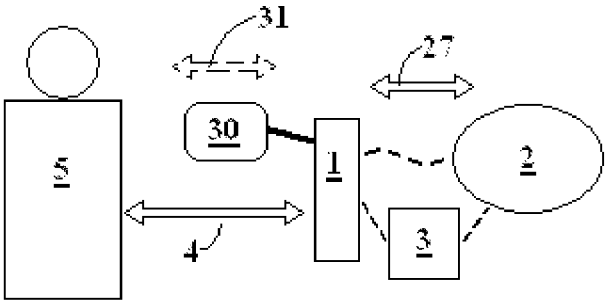
FIG. 23*a* is a schematic representation of the system of the first preferred embodiment further comprising a forcing device, wherein the forcing device applies force to the mechanical force input interface assisting the force input into the mechanical force input interface by the user, represented before the action of the trigger mechanism.
Figure 23B:
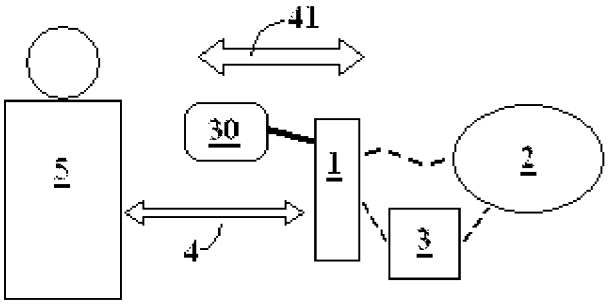
FIG. 23*b* is a schematic representation of the system of the first preferred embodiment further comprising a forcing device, represented after the action of the trigger mechanism, wherein the action of the trigger mechanism has caused the net force applied to the mechanical force input interface by the force resistor and the forcing device to be in assistance to the force input to the mechanical force input interface by the user.
Figure 24A:
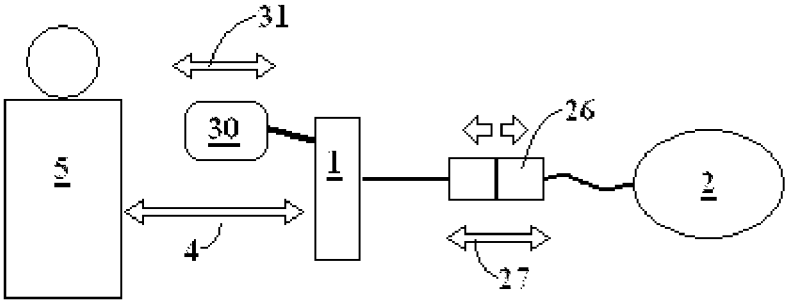
FIG. 24*a* is a schematic representation of the system of the first preferred embodiment further comprising a forcing device, wherein the forcing device applies force to the mechanical force input interface assisting the force input into the mechanical force input interface by the user, wherein the trigger mechanism comprises a disconnect.
Figure 24B:
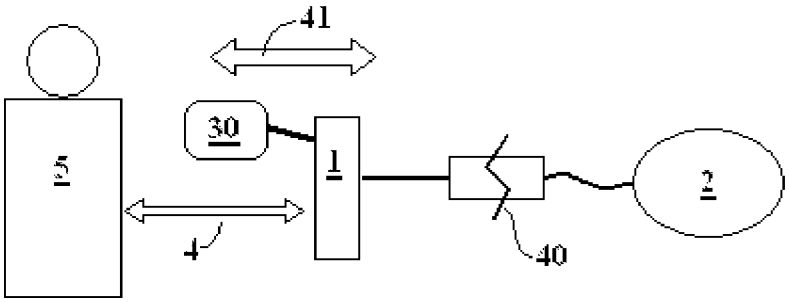
FIG. 24*b* is a schematic representation of the system of the first preferred embodiment further comprising a forcing device, wherein the trigger mechanism comprises a disconnect, wherein the uncoupling of the disconnect has caused the net force applied to the mechanical force input interface by the force resistor and the forcing device to be in assistance to the force input to the mechanical force input interface by the user.

As shown in FIGS. 23*a* and 23*b*, in the system of the first preferred embodiment including a forcing device 30, the action of the trigger mechanism 3 preferably causes the net force applied to the mechanical force input interface 1 by the force resistor 2 and the forcing device 30 to shift to being in assistance to the force input to the mechanical force input interface 1 by the user 5. As shown in FIG. 23*a*, before the action of the trigger mechanism 3 there is a force 27 transmitted between the force resistor 2 and the mechanical force input interface 1 and there may be, depending upon the action of the forcing device 30, a force 31 applied to the mechanical force input interface 1 assisting the force input into the mechanical force input interface 1 by the user 5; as shown in FIG. 23*b*, the action of the trigger mechanism 3 causes the net force 41 applied to the mechanical force input interface 1 by the force resistor 2 and the forcing device 30 to be in assistance to the force input 4 into the mechanical force input interface 1 by the user 5. In a first preferred variation of the trigger mechanism 3 of the system of the first preferred embodiment including a forcing device 30, as shown in FIG. 24*a*, the trigger mechanism 3 comprises a disconnect 26 coupled to the mechanical force input interface 1 and coupled to the force resistor 2. The disconnect 26 is preferably designed to transmit force 27 between the force resistor 2 and the mechanical force input interface 1, and is preferably designed to uncouple the force resistor 2 and the mechanical force input interface 1. As shown in FIG. 24*b*, preferably after the action of the disconnect 26 has uncoupled 40 the force resistor 2 and the mechanical force input interface 1, the resulting net force 41 applied to the mechanical force input interface 1 by the force resistor 2 and the forcing device 30 is in assistance to the force input 4 into the mechanical force input interface 1 by the user 5. The trigger mechanism 3 in the system of the first preferred embodiment including a forcing device 30 may, however, have any suitable design, carry out any suitable actions, and cause any suitable change in the resistance provided against the force input 4 by the user 5.

Figure 25:
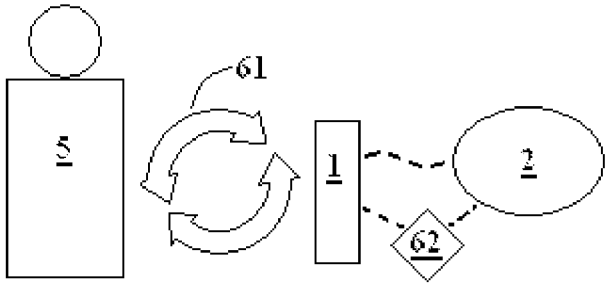
FIG. 25 is a schematic representation of the system of the first preferred embodiment wherein the user inputs force into the mechanical force input interface cyclically, wherein the trigger mechanism is adapted to operate cyclically.

As shown in FIG. 25, in another preferred variation of the system of the first preferred embodiment, the user 5 inputs force into the mechanical force input interface 1 cyclically 61 and the trigger mechanism 62 is designed to operate cyclically. In a first preferred variation the trigger mechanism 62 operates one or more times in every cycle of cyclical user force input 61. In a second preferred variation the trigger mechanism 62 operate once in a certain multiple of cycles of cyclical user force input 61. In a third preferred variation the trigger mechanism 62 operates at uneven points or pre-programmed points within the cycles of user force input 61. In an alternative variation the trigger mechanism 62 operates randomly within the cycles of cyclical user force input 61. The trigger mechanism 62 may, however, operate at any suitable time or times during the cyclical user force input 61.

2. Second Preferred Embodiment

Figure 26:
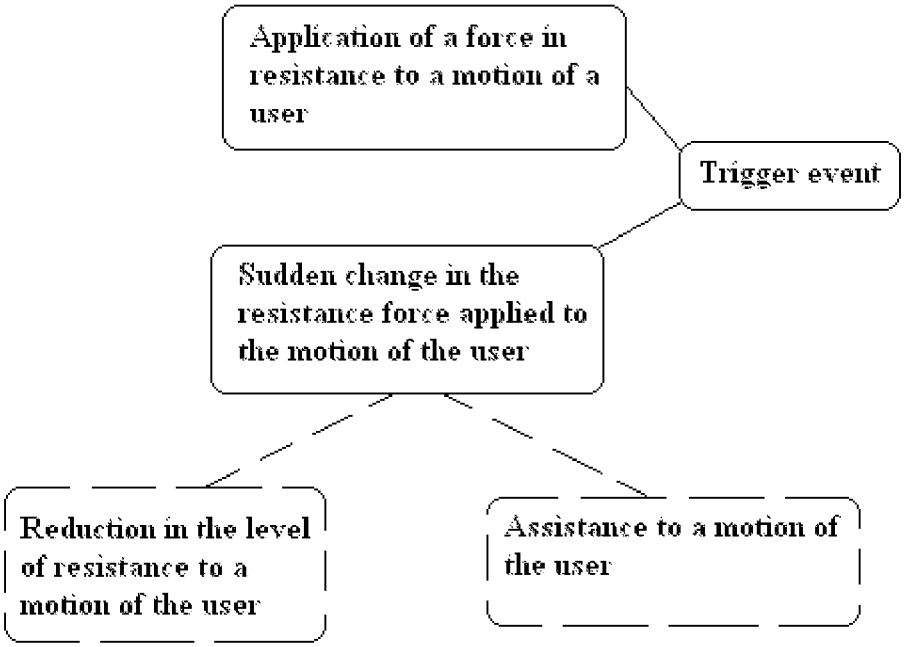
FIG. 26 is a flow chart representation of the system of the second preferred embodiment.

As shown in FIG. 26, the exercise method of the second preferred embodiment includes (a) the application of a force in resistance to a motion of a user; (b) a trigger event; and (c) a sudden change in the resistance force applied to the motion of the user. The change in resistance force either reduces the level of resistance to a motion of the user, or creates assistance to a motion of the user. The exercise method of the second preferred embodiment is designed to exercise muscles in a way that improves muscle speed, explosiveness, or both. The exercise method of second preferred embodiment may be used to exercise any muscle of the body in any motion, providing any muscle in any motion with increased speed, explosiveness, or both. The exercise method of the second preferred embodiment, however, may be used for any suitable purpose.

Figure 27:
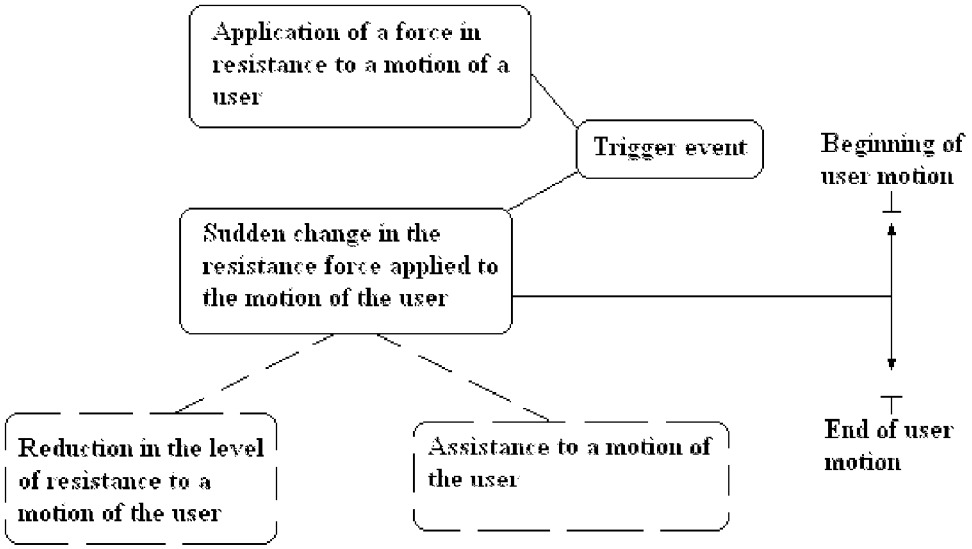
FIG. 27 is a flow chart representation of the system of the second preferred embodiment wherein the sudden change in the resistance force applied to the motion of the user is adapted to occur within the range of motion of a motion of the user and during a motion of the user.

As shown in FIG. 27, the sudden change in the resistance force applied to the motion of the user preferably occurs within the range of motion of the user, after the motion of the user has started and before the motion of the user stops. The sudden change in the resistance force applied to the motion of the user may, however, take place at any suitable point. Preferably the sudden change in resistance force creates two or more separate phases of user motion, one or more phase with greater resistance to user motion and one or more phase with either less resistance to user motion or assistance to user motion. The sudden change in user motion may, however, create any suitable result.

Figure 28:
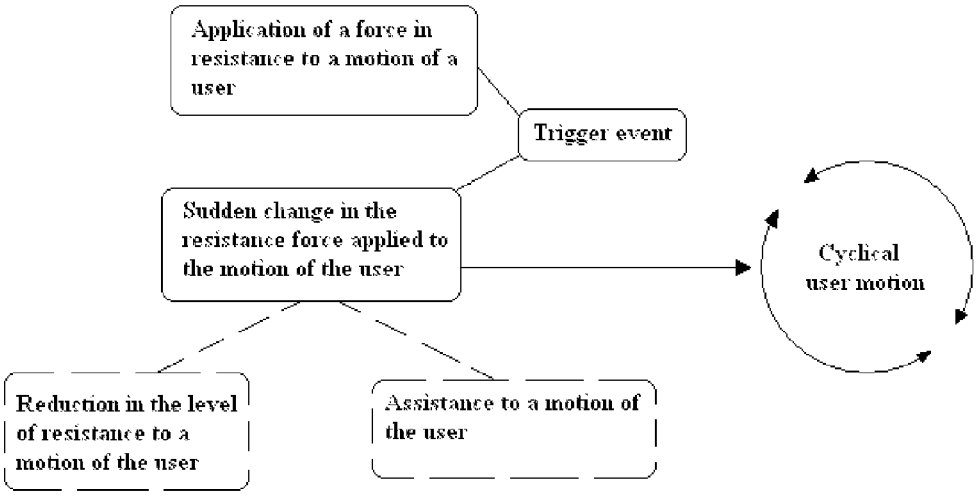
FIG. 28 is a flow chart representation of the system of the second preferred embodiment wherein a motion of the user is cyclical and the sudden change in the resistance force applied to the motion of the user takes place in the cyclical user motion.

As shown in FIG. 28, in a preferred variation of the method of the second preferred embodiment, a motion of the user is cyclical and the sudden change in the resistance force applied to the motion of the user takes place cyclically. In a first preferred variation, the sudden change in resistance force takes place one or more times per cycle of user motion. In a second preferred variation, the sudden change in resistance force takes place once in every multiple number of cycles of user motion. In a third preferred variation, the sudden change in resistance force takes place at uneven points within the cycles of user motion. In an alternative variation, the sudden change in resistance force takes place randomly within the cycles of user motion.

3. Third Preferred Embodiment

Figure 29A:
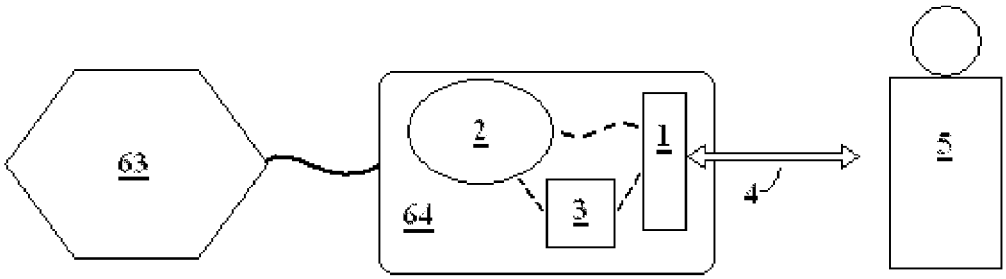
FIG. 29*a* is a schematic representation of the system of the third preferred embodiment wherein the exercise device is coupled to the piece of sports equipment.
Figure 29B:
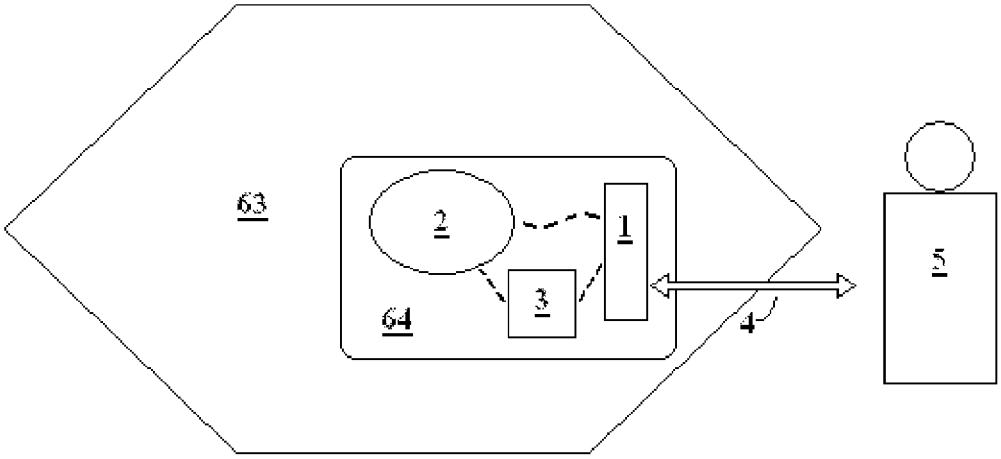
FIG. 29*b* is a schematic representation of the system of the third preferred embodiment wherein the exercise device is integrated into the piece sports equipment.

As shown in FIGS. 29*a* and 29*b*, the sports equipment 63 of the third preferred embodiment includes a piece of sports equipment 63 and an exercise device 64 either coupled to the piece of sports equipment 63 as shown in FIG. 29*a*, or integrated into the piece of sports equipment 63 as shown in FIG. 29*b*. The exercise device 64 includes a mechanical force input interface 1 designed to interface with a user 5; a force resistor 2 designed to resist force input into the mechanical force input interface 1 by a user 5; and a trigger mechanism 3 designed to cause a sudden change in the resistance provided against the force input 4 by the user 5. The force resistor 2 is coupled to one of: the mechanical force input interface 1, the trigger mechanism 3, or both. The trigger mechanism 3 is coupled to one of: the mechanical force input interface 1, the force resistor 2, or both.

The elements of the third preferred embodiment preferably function in the same way and have the same alternatives and preferred variations as the similar elements of the first preferred embodiment.

The sports equipment 63 of the third preferred embodiment preferably includes one of: a bicycle, a rowboat, a racket, a bat, a club, a human powered vehicle, and a piece of track and field equipment. The sports equipment 63 may, however, include any suitable device or equipment. In a first preferred variation the exercise device 64 of the third preferred embodiment is either integrated into the pedal mechanism or drive mechanism of a bicycle or a human powered vehicle, or coupled to the pedal mechanism or drive mechanism of a bicycle or a human powered vehicle. In a second preferred variation the exercise device 64 of the third preferred embodiment is either integrated into the oar supports or rowing mechanism of a rowboat or other water vehicle, or coupled to the oar supports or rowing mechanism of a rowboat or other water vehicle. In a third preferred variation the exercise device 64 is either coupled to the handle or user interface of a racket, a bat, a club, or a piece of track and field equipment, or integrated into the handle or user interface of a racket, a bat, a club, or a piece of track and field equipment. The exercise device 64 of the third preferred embodiment may, however, be used with any suitable piece of sports equipment 63 in any suitable manner.

As a person skilled in the prior art will recognize after examination of the previous detailed description and the figures and claims, modifications and changes may be made to the preferred embodiments of the invention without departing from the scope of the invention as defined in the following claims.

What is claimed is:

1. An exercise machine adapted to create explosive muscle movement comprising: a mechanical force input interface adapted to interface with a user; a force resistor adapted to resist force input into the mechanical force input interface by the user; and a trigger mechanism adapted to cause a sudden change in the resistance provided against the force input by the user, wherein the force resistor is coupled to at least one of the mechanical force input interface and the trigger mechanism, and the trigger mechanism is coupled to at least one of the mechanical force input interface and the force resistor, wherein the sudden change in resistance provided against the force input by the user is a net reduction in the resistance force along the original resistance force direction of at least 60% of the original resistance force, and wherein the sudden change occurs in less than 500 milliseconds.

2. The exercise machine adapted to create explosive muscle movement of claim 1 wherein the sudden change in the resistance provided against the force input by the user is adapted to at least one of (a) reduce the resistance provided against the force input by the user, (b) provide force assisting the force input by the user, and (c) change the direction of the resistance provided against the force input by the user, wherein the net reduction in the resistance force along the original force direction of at least 60% of the original resistance force in less than 500 milliseconds occurs in normal operation of the exercise machine.

3. The exercise machine adapted to create explosive muscle movement of claim 2 wherein the force resistor comprises at least one weight.

4. The exercise machine adapted to create explosive muscle movement of claim 2 wherein the force resistor comprises at least one of (a) a hydraulic device, (b) a pneumatic device, (c) at least one spring, and (d) at least one elastic member.

5. The exercise machine adapted to create explosive muscle movement of claim 2 wherein the force resistor comprises a friction mechanism.

6. The exercise machine adapted to create explosive muscle movement of claim 2 wherein the force resistor comprises at least one of (a) an electromechanical device, (b) a magnetic device, (c) an electromagnetic device, (d) an actuator, and (e) a flowing fluid adapted to induce drag.

7. The exercise machine adapted to create explosive muscle movement of claim 2 wherein the mechanical force input interface comprises at least one of (a) at least one pedal, (b) a platform, and (c) at least one padded structural member.

8. The exercise machine adapted to create explosive muscle movement of claim 7, wherein the force resistor comprises at least one of (a) a hydraulic device, (b) a pneumatic device, (c) at least one weight, (d) at least one spring, and (e) at least one elastic element.

9. The exercise machine adapted to create explosive muscle movement of claim 2 wherein the mechanical force input interface comprises at least one of (a) a bar, (b) at least one strap, and (c) at least one handle.

10. The exercise machine adapted to create explosive muscle movement of claim 2 wherein the mechanical force input interface comprises at least one of (a) an article of clothing, (b) at least one shoe, and (c) at least one glove.

11. The exercise machine adapted to create explosive muscle movement of claim 2 wherein the trigger mechanism is adapted to cause at least one of (a) a reduction in the resistance force transmitted between the force resistor and the mechanical force input interface, (b) the elimination of force transmission between the force resistor and the mechanical input interface, and (c) a change in direction of the force transmitted between the force resistor and the mechanical force input interface.

12. The exercise machine adapted to create explosive muscle movement of claim 2 wherein the trigger mechanism is coupled to a trigger, wherein the trigger is adapted to control the trigger mechanism.

13. The exercise machine adapted to create explosive muscle movement of claim 12 wherein the trigger comprises at least one of (a) a mechanical system, (b) an electronic system, (c) an electromechanical system, and (d) a processor coupled to at least one of (1) an electronic system and (2) an electromechanical system.

14. The exercise machine adapted to create explosive muscle movement of claim 12 wherein the trigger controls the trigger mechanism automatically.

15. The exercise machine adapted to create explosive muscle movement of claim 12 wherein the user controls the trigger and the trigger controls the trigger mechanism only when given input from the user.

16. The exercise machine adapted to create explosive muscle movement of claim 13 comprising more than one trigger, wherein the user controls at least one trigger and at least one trigger comprises automatic control, wherein the trigger mechanism is controlled by a combination of the at least one trigger controlled by the user and the at least one trigger comprising automatic control.

17. The exercise machine adapted to create explosive muscle movement of claim 2 wherein the user inputs force into the mechanical force input interface cyclically, wherein the trigger mechanism is adapted to operate cyclically.

18. The exercise machine adapted to create explosive muscle movement of claim 2 wherein the trigger mechanism comprises a disconnect coupled to the mechanical force input interface and coupled to the force resistor, wherein the disconnect is adapted to transmit force between the force resistor and the mechanical force input interface, wherein the disconnect is further adapted to uncouple the force resistor and the mechanical force input interface.

19. The exercise machine adapted to create explosive muscle movement of claim 18 wherein the uncoupling of the force resistor and the mechanical force input interface causes at least one of (a) a reduction in the resistance force transmitted between the force resistor and the mechanical force input interface, (b) the elimination of resistance force transmission between the force resistor and the mechanical force input interface, and (c) a change in the direction of the resistance force transmitted between the force resistor and the mechanical force input interface.

20. The exercise machine adapted to create explosive muscle movement of claim 2 further comprising a forcing device coupled to the mechanical force input interface, wherein the forcing device applies force to the mechanical force input interface assisting the force input into the mechanical force input interface by the user one of (a) at least once during the operation of the exercise machine and (b) continuously.

21. The exercise machine adapted to create explosive muscle movement of claim 20 wherein the forcing device comprises at least one of (a) at least one spring, (b) at least one elastic element, (c) an actuator, (d) a pneumatic device, (e) a hydraulic device, (f) an electromagnetic device, (g) an electromechanical device, and (h) a magnetic device.

22. The exercise machine adapted to create explosive muscle movement of claim 2 wherein the coupling between the mechanical force input interface and at least one of (a) the force resistor and (b) the trigger mechanism comprises at least one cable.

23. The exercise machine adapted to create explosive muscle movement of claim 1 wherein wherein the sudden change in resistance provided against the force input by the user occurs within the range of motion of the user while the user is applying force to the mechanical force input interface.

24. The exercise machine adapted to create explosive muscle movement of claim 23 wherein the trigger mechanism operates cyclically at least one of (a) at least once per cycle of cyclical user force input, (b) once in a multiple of cycles of cyclical user force input, (c) at uneven points within the cycles of cyclical user force input, and (d) randomly within the cycles of cyclical user force input.

25. The exercise machine adapted to create explosive muscle movement of claim 23 wherein the trigger mechanism comprises a disconnect coupled to the mechanical force input interface and coupled to the force resistor, wherein the disconnect is adapted to transmit force between the force resistor and the mechanical force input interface, wherein the disconnect is further adapted to uncouple the force resistor and the mechanical force input interface, wherein the disconnect is further adapted to operate during the range of motion of the user while the user is applying force to the mechanical force input interface.

26. The exercise machine adapted to create explosive muscle movement of claim 25 wherein the user inputs force into the mechanical force input interface cyclically, wherein the trigger mechanism is adapted to operate cyclically, wherein the trigger mechanism is adapted to operate without the user creating input into the trigger mechanism outside of the cyclical force input into the mechanical force input interface by the user.

27. The exercise machine adapted to create explosive muscle movement of claim 25 wherein the operation of the disconnect is adapted to create a large acceleration in muscle movement during the range of motion of the user.

28. The exercise machine adapted to create explosive muscle movement of claim 23 wherein the force resistor is adapted to resist force input into the mechanical force input interface only, wherein the force resistor does not apply significant force to the mechanical force input interface in the absence of force input into the mechanical force input interface by the user.

29. The exercise machine adapted to create explosive muscle movement of claim 18 wherein the force resistor adapted to resist force input into the mechanical force input interface only comprises at least one of a) a hydraulic resistance device, b) a friction resistance device, c) a magnetic induction resistance device, and d) a fluid drag resistance device.

30. The exercise machine adapted to create explosive muscle movement of claim 29 further comprising a forcing device coupled to the mechanical force input interface, wherein the forcing device applies force to the mechanical force input interface assisting the force input into the mechanical force input interface by the user one of (a) at least once during the operation of the exercise machine and (b) at least once during each range of exercise motion of the user.

31. The exercise machine adapted to create explosive muscle movement of claim 29 wherein the trigger mechanism comprises a disconnect coupled to the mechanical force input interface and coupled to the force resistor, wherein the disconnect is adapted to transmit force between the force resistor and the mechanical force input interface, wherein the disconnect is further adapted to uncouple the force resistor and the mechanical force input interface, wherein the disconnect is further adapted to operate during the range of motion of the user while the user is applying force to the mechanical force input interface.

32. The exercise machine adapted to create explosive muscle movement of claim 23 wherein the sudden change in resistance provided against the force input by the user is adapted to create a sudden motion during the range of exercise motion of the user that is as at least as fast as the user is capable of moving through that same exercise motion under no resistance load.

33. The exercise machine adapted to create explosive muscle movement of claim 32 wherein the exercise machine adapted to create explosive muscle movement further comprises a brake mechanism, wherein the brake mechanism is adapted to slow the motion of the user before the user reaches the end of the range of motion of at least one of (a) their body and (b) the exercise machine adapted to create explosive muscle movement.

34. The exercise machine adapted to create explosive muscle movement of claim 23 wherein the exercise machine adapted to create explosive muscle movement further comprises a brake mechanism, wherein the brake mechanism is adapted to slow the motion of the user before the user reaches the end of the range of motion of at least one of (a) their body and (b) the exercise machine adapted to create explosive muscle movement.

35. The exercise machine adapted to create explosive muscle movement of claim 34 wherein the trigger mechanism comprises a disconnect coupled to the mechanical force input interface and coupled to the force resistor, wherein the disconnect is adapted to transmit force between the force resistor and the mechanical force input interface, wherein the disconnect is further adapted to uncouple the force resistor and the mechanical force input interface, wherein the uncoupling of the force resistor and the mechanical force input interface causes the net force applied to the mechanical force input interface by the force resistor and the forcing device to be in assistance to the force input into the mechanical force input interface by the user.

36. The exercise machine adapted to create explosive muscle movement of claim 35 wherein the mechanical force input interface comprises at least one of (a) a bar, (b) at least one handle, and (c) at least one strap.

37. The exercise machine adapted to create explosive muscle movement of claim 1 wherein the exercise machine adapted to create explosive muscle movement further comprises a brake mechanism, wherein the brake mechanism is adapted to slow the motion of the user before the user reaches the end of the range of motion of at least one of (a) their body and (b) the exercise machine adapted to create explosive muscle movement.

* * * * *